US008752926B2

(12) United States Patent
Konishi

(10) Patent No.: US 8,752,926 B2
(45) Date of Patent: Jun. 17, 2014

(54) LIQUID EJECTING APPARATUS

(71) Applicant: Seiko Epson Corporation, Tokyo (JP)

(72) Inventor: Akio Konishi, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/767,283

(22) Filed: Feb. 14, 2013

(65) Prior Publication Data

US 2013/0215174 A1 Aug. 22, 2013

(30) Foreign Application Priority Data

| | | |
|---|---|---|
| Feb. 16, 2012 | (JP) | 2012-031450 |
| Feb. 16, 2012 | (JP) | 2012-031451 |
| Mar. 2, 2012 | (JP) | 2012-047422 |
| Mar. 2, 2012 | (JP) | 2012-047423 |
| Mar. 26, 2012 | (JP) | 2012-070456 |
| Nov. 6, 2012 | (JP) | 2012-244181 |

(51) Int. Cl.

| | |
|---|---|
| ***B41J 29/38*** | (2006.01) |
| ***B41J 2/045*** | (2006.01) |
| *B41J 2/14* | (2006.01) |

(52) U.S. Cl.

CPC ..... *B41J 2/04581* (2013.01); *B41J 2/04588* (2013.01); *B41J 2002/14266* (2013.01); *B41J 2/14233* (2013.01)

USPC ..... 347/10; 347/68

(58) Field of Classification Search

CPC ..... B41J 2/04581; B41J 2/04588; B41J 2002/14266; B41J 2/14233

USPC ..... 347/9–11, 68, 70–72

See application file for complete search history.

(56) References Cited

U.S. PATENT DOCUMENTS

| | | | | |
|---|---|---|---|---|
| 7,055,921 | B2 * | 6/2006 | Sumi | 347/10 |
| 7,896,456 | B2 * | 3/2011 | Iwashita et al. | 347/10 |
| 8,534,802 | B2 * | 9/2013 | Miyazawa et al. | 347/68 |
| 2007/0241642 | A1 | 10/2007 | Miyazawa et al. | |

FOREIGN PATENT DOCUMENTS

| | | |
|---|---|---|
| JP | 2007-287745 | 11/2007 |

* cited by examiner

*Primary Examiner* — An Do

(74) *Attorney, Agent, or Firm* — Harness, Dickey & Pierce, P.L.C.

(57) ABSTRACT

A liquid ejecting apparatus includes a piezoelectric element provided with a piezoelectric layer and an electrode provided on the piezoelectric layer; and a driving unit supplying a driving waveform driving the piezoelectric element to the piezoelectric element.

8 Claims, 10 Drawing Sheets

LIQUID EJECTING APPARATUS

The entire disclosure of Japanese Patent Application No. 2012-031450, filed Feb. 16, 2012; No. 2012-031451, filed Feb. 16, 2012; No. 2012-047422, filed Mar. 2, 2012; No. 2012-047423, filed Mar. 2, 2012; No. 2012-070456, filed Mar. 26, 2012; and No. 2012-244181, filed Nov. 6, 2012 are incorporated by reference herein.

BACKGROUND

1. Technical Field

The present invention relates to a liquid ejecting apparatus provided with a piezoelectric element having an electrode and a piezoelectric layer generating a change in pressure in a pressure generating chamber communicating with a nozzle opening.

2. Related Art

As a typical example of a liquid ejection head mounted on a liquid ejecting apparatus there is, for example, an ink jet type recording head, in which a part of the pressure generating chamber communicating with the nozzle opening ejecting ink droplets is configured by a vibration plate, and in which the vibration plate is deformed by a piezoelectric element to eject the ink of the pressure generating chamber as ink droplets from a nozzle opening by applying pressure thereto.

Typical examples of a piezoelectric material used as the piezoelectric layer configuring this kind of piezoelectric element include lead zirconate titanate (below, referred to as PZT) can be given; however, from the viewpoint of environmental problems, there is a demand for lead-free or reduced lead content piezoelectric material. Thus, as lead-free piezoelectric materials, for example, there are $BiFeO_3$ based piezoelectric materials containing Bi and Fe (for example, JP-A-2007-287745).

However, since such a piezoelectric layer formed of a lead-free or reduced lead content compound oxide does not have a sufficient displacement amount in comparison with lead zirconate titanate (PZT), there is a demand for the improvement of the displacement amount.

Here, of course, such a problem is similarly present even in other liquid ejecting heads ejecting liquid droplets other than ink as well as the ink jet type recording head, and also similarly present even in piezoelectric element used other than in liquid ejecting heads.

SUMMARY

An advantage of some aspects of the invention is that it provides a liquid ejecting apparatus which is able to obtain a sufficient displacement characteristic using a compound oxide with a perovskite structure including bismuth, iron, barium, and titanium as piezoelectric material.

According to an aspect of the invention, there is provided a liquid ejecting apparatus including: a piezoelectric element provided with a piezoelectric layer and an electrode provided on the piezoelectric layer; and a driving unit supplying a driving waveform driving the piezoelectric element to the piezoelectric element, in which the piezoelectric layer is formed of a composite oxide having a perovskite structure including bismuth, iron, barium and titanium, in which the driving waveform has a waiting process of applying an intermediate potential to the piezoelectric layer, a first voltage changing process of applying a voltage of the opposite polarity to the intermediate potential from the application state of the intermediate potential, and decreasing the potential to the minimum, and a second voltage changing process of applying a voltage greater than the intermediate potential and ejecting a liquid, and increasing the potential to the maximum from the minimum potential, and in which an electric field applied to the piezoelectric layer by the application of the intermediate potential is 11.1 V/μm or more, and is greater than half of a difference between the maximum potential and the minimum potential in the electric field applied to the piezoelectric layer.

In the invention, by the electric field applied to the piezoelectric layer by the application of the intermediate potential to be applied to the piezoelectric element in the waiting state being 11.1 V/μm or more, and being greater than half of a difference between the maximum potential and the minimum potential in the electric field applied to the piezoelectric layer, it is possible to realize a liquid ejecting apparatus with a large displacement amount. In addition, since the piezoelectric material is lead-free, that is, does not contain lead, it is possible to realize a liquid ejecting apparatus having a small impact on the environment.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
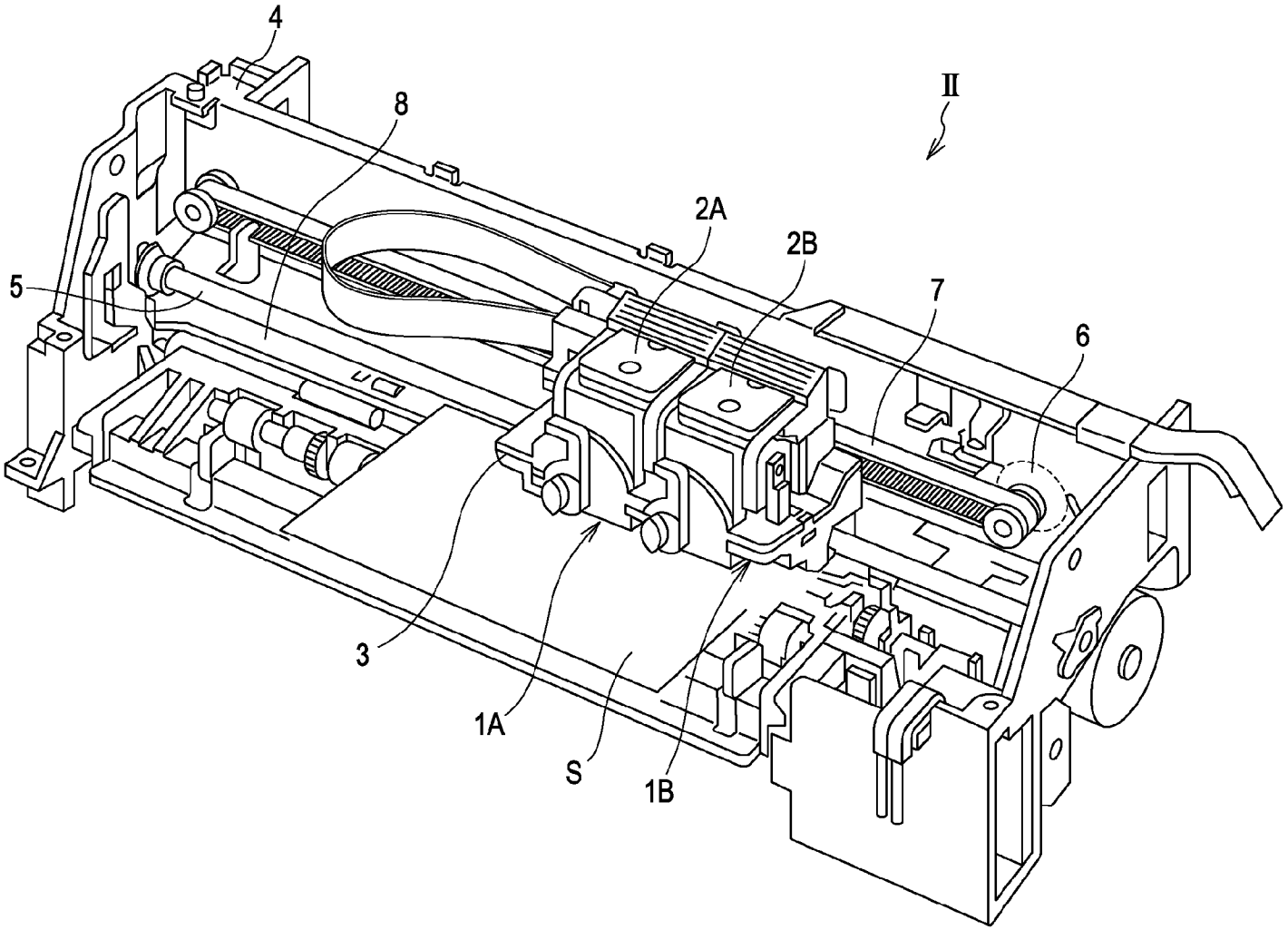
FIG. 1 is a view showing a schematic configuration of an ink jet type recording apparatus according to an embodiment of the invention.

FIG. 1 is a schematic view showing an example of an ink jet type recording apparatus which is an example of a liquid ejecting apparatus according to the present embodiment. As shown in FIG. 1, in an ink jet type recording apparatus II, recording head units 1A and 1B having ink jet type recording heads are provided so that cartridges 2A and 2B configuring ink supplying means can be mounted and removed, and a carriage 3 having the recording head units 1A and 1B mounted thereon is provided on a cartridge axis 5 attached to an apparatus main body 4 so as to be able to freely move in the axis direction. The recording head units 1A and 1B eject a black ink composition and a color ink composition, respectively.

Then, the carriage 3 having the recording head units 1A and 1B mounted thereon is moved along the cartridge axis 5 by transmitting the driving force of a driving motor 6 to the carriage 3 via a plurality of gears, which are not shown, and a timing belt 7. On the other hand, a platen 8 is provided along the cartridge axis 5 in the apparatus main body 4, and a recording sheet S, which is a recording medium such as paper supplied by a paper supplying roller or the like, which is not shown, is rolled on the platen 8 and transported.

Here, description will be given of the ink jet type recording head mounted on such an ink jet type recording apparatus II with reference to FIGS. 2 to 4. Here, FIG. 2 is an exploded perspective view showing the schematic configuration of an ink jet type recording head which is an example of the liquid ejecting head according to the present embodiment, FIG. 3 is a plan view of FIG. 2, and FIG. 4 is a cross-sectional view taken along the IV-IV in FIG. 3.

Figure 2:
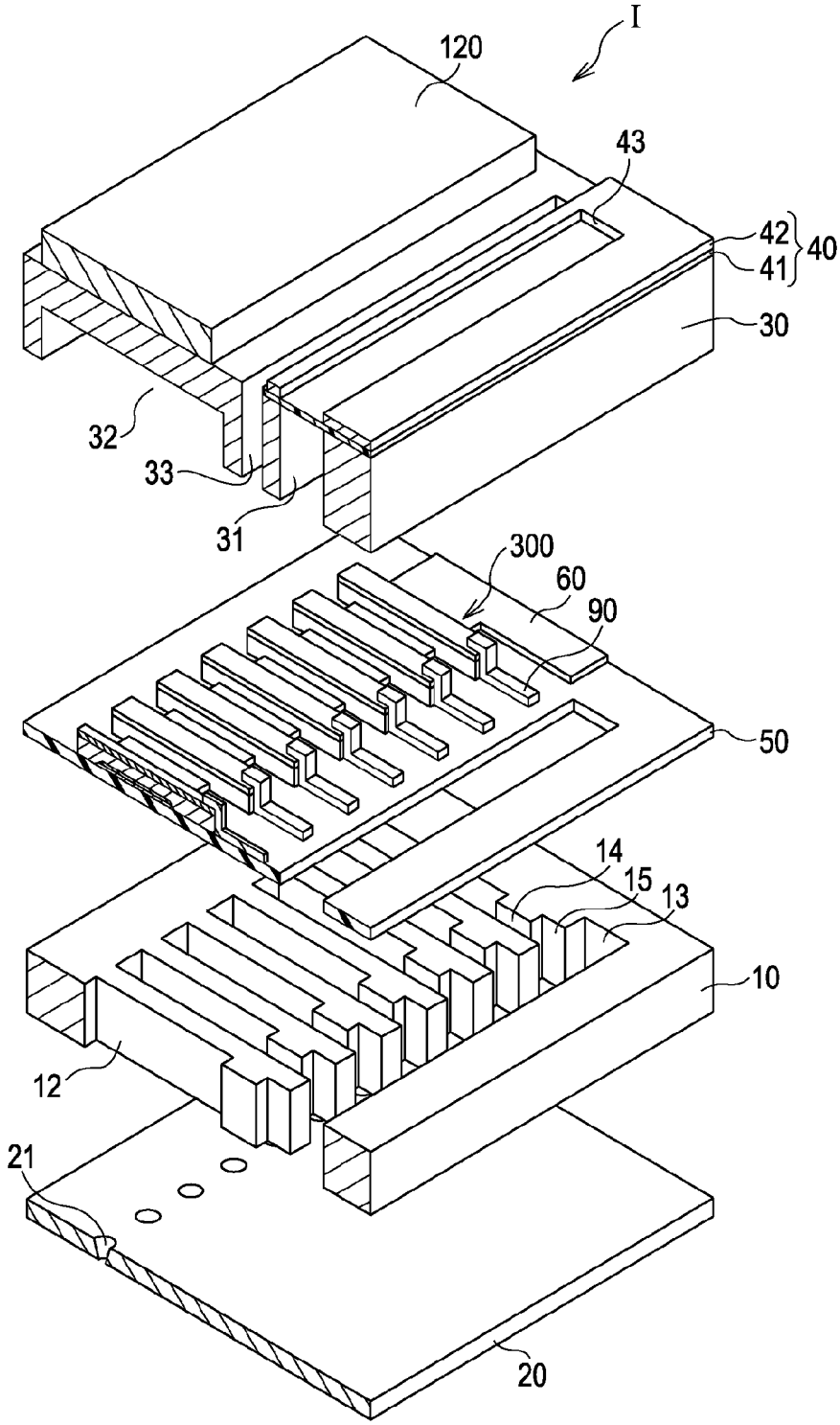
FIG. 2 is an exploded perspective view showing a schematic configuration of a recording head according to the embodiment.
Figure 3:
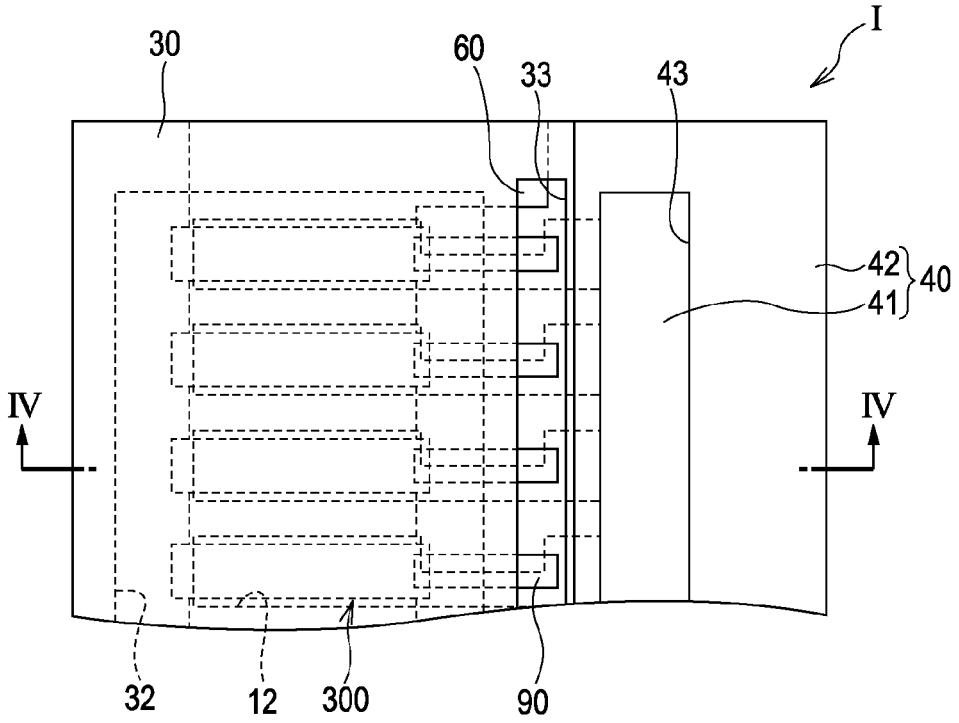
FIG. 3 is a plan view of the recording head according to the embodiment.
Figure 4:
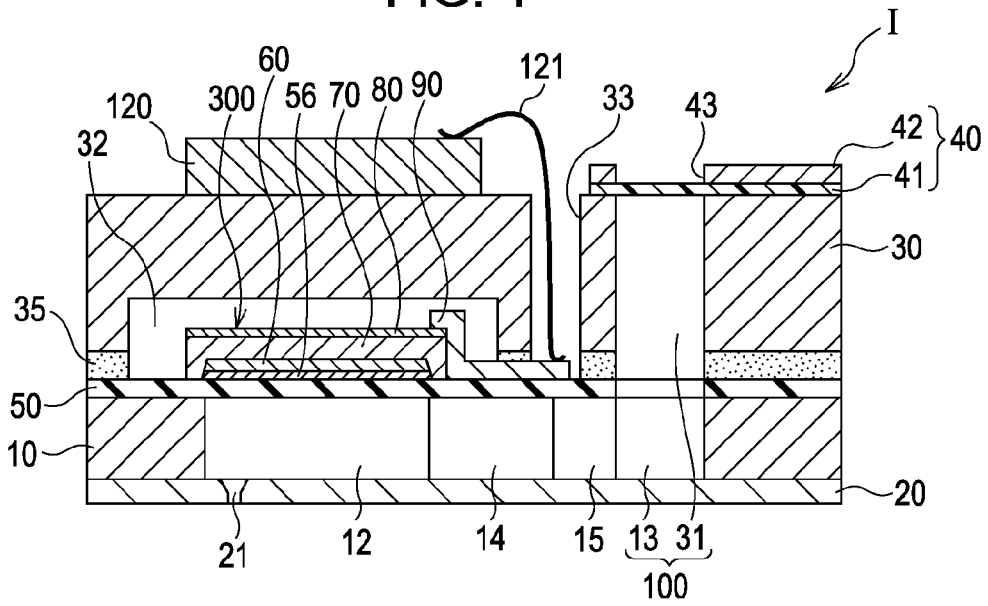
FIG. 4 is a cross-sectional view of the recording head according to the embodiment.

As shown in FIGS. 2 to 4, a flow channel-forming substrate 10 of the present embodiment is formed of a silicon single crystal substrate and has an elastic film 50 formed of silicon dioxide formed on one surface.

A plurality of pressure generating chambers 12 are provided in parallel in the width direction in the flow channel-forming substrate 10. In addition, a communicating portion 13 is formed in an outside region in the longitudinal direction of the pressure generating chambers 12 in the flow channel-forming substrate 10, and the communicating portion 13 and each of the pressure generating chambers 12 are communicated with each other via an ink supply channel 14 and a communicating channel 15 provided at each of the pressure generating chambers 12. The communicating portion 13 is communicated with a manifold portion 31 of a protective substrate as described below and configures a part of a manifold which is a common ink chamber of each pressure generating chamber 12. The ink supply channel 14 is formed to be narrower in width than the pressure generating chamber 12, and maintains a constant resistance at the flow channel to ink flowing into the pressure generating chamber 12 from the communicating portion 13. Here, in the present embodiment, the ink supply channel 14 is formed by narrowing the width of the flow channel from one side; however, the ink supply channel may be formed by narrowing the width of the flow channel from both sides. In addition, the ink supply channel may be formed by narrowing the flow channel in the thickness direction instead of narrowing the width of the flow channel. In the present embodiment, the flow channel-forming substrate 10 is provided with a liquid flow channel formed of the pressure generating chamber 12, the communicating portion 13, the ink supply channel 14, and the communicating channel 15.

In addition, a nozzle plate 20 provided with punctured nozzle openings 21 communicating with the vicinities of the end portions on the opposite side to the ink supply channel 14 in each pressure generating chamber 12 is fixed to the opening surface side of the flow channel-forming substrate 10 using an adhesive, a thermally weldable film, or the like. Here, the nozzle plate 20 is formed of, for example, a glass ceramic, a silicon single crystal substrate, stainless steel, or the like.

On the other hand, the above-described elastic film 50 is formed on the opposite side to the opening surface of the flow channel-forming substrate 10, and an adhering layer 56 formed of, for example, approximately 30 nm to 50 nm thick titanium oxide or the like is provided on the elastic film 50 in order to improve the adhesiveness of the elastic film 50 and the like with the foundation of a first electrode 60. Here, an insulating film formed of zirconium oxide or the like may be provided on the elastic film 50 according to necessity.

Furthermore, the first electrode 60, a piezoelectric layer 70, which is a thin film having a thickness of 3 μm or less, and preferably 0.3 μm to 1.5 nm, and a second electrode 80 are laminated on the adhering layer 56, thereby configuring a piezoelectric element 300 as a pressure generating unit generating a change in the pressure in the pressure generating chamber 12. Here, the piezoelectric element 300 refers to a portion including the first electrode 60, the piezoelectric layer 70, and the second electrode 80. Generally, any one of the electrodes in the piezoelectric element 300 forms a common electrode, and the other electrode and the piezoelectric layer 70 are configured by being patterned for each of the pressure generating chambers 12. In the present embodiment, the first electrode 60 is used as the common electrode of the piezoelectric element 300, and the second electrode 80 is used as the individual electrode of the piezoelectric element 300; however, there is no problem if these are switched for convenience of a driving circuit or wiring. In addition, herein, the piezoelectric element 300 and a vibrating plate which is displaced by the driving of the piezoelectric element 300 will be referred to collectively as an actuator apparatus. Here, in the above-described example, the elastic film 50, the adhering layer 56, the first electrode 60, and the insulating film provided according to necessity act as the vibrating plate; however, the embodiment is naturally not limited thereto, and, for example, the elastic film 50 or the adhering layer 56 may not be provided. In addition, the piezoelectric element 300 itself may be set to substantially serve as the vibrating plate.

Then, in the present embodiment, the piezoelectric material configuring the piezoelectric layer 70 is a compound oxide having a perovskite structure that includes bismuth (Bi), iron (Fe), barium (Ba), and titanium (Ti). The A site of the perovskite structure, that is, an $ABO_3$ type structure is coordinated with 12 oxygen atoms, and in addition the B site is coordinated with 6 oxygen atoms, thereby forming an octahedron. Bi and Ba are located in the A site, and Fe and Ti are located in the B site.

The complex oxide having the perovskite structure that includes Bi, Fe, Ba, and Ti is presumed to be a structure which may be represented as a compound oxide having a mixed crystal perovskite structure of bismuth ferrite and barium titanate, or a solid solution in which bismuth ferrite and barium titanate are evenly solid soluted. Here, in an X-ray diffraction pattern, the bismuth ferrite and barium titanate are not detected singly.

Here, the bismuth ferrite and barium titanate are known piezoelectric material respectively having a perovskite structure, and ones with various configurations are known, respectively. For example, as bismuth ferrite and barium titanate, as well as $BiFeO_3$ and $BaTiO_3$, ones in which elements (Bi, Fe, Ba, Ti, O) are partially deficient or excessive, or in which a part of the element is substituted with another element are known; however, in the present embodiment, where bismuth ferrite and barium titanate are represented, ones in which there is deviation from the stoichiometric composition due to deficiency or excess, or ones in which a part of the elements is substituted with another element, are set to be included in the range of bismuth ferrite and barium titanate. In addition, it is also possible to change the ratio of bismuth ferrite and barium titanate in various ways.

The composition of the piezoelectric layer 70 formed of a compound oxide having such a perovskite structure is represented, for example, as the mixed crystal represented by the following general formula (1). In addition, it is possible to represent this formula (1) by the following general formula (1'). Here, the description of the general formula (1) and the general formula (1') is a composition expression based on stoichiometry, and, as described above, to the extent that a perovskite structure is obtainable, inevitable composition deviation due to lattice mismatch, oxygen loss, and the like is of course allowed, as well as partial substitution or the like of the elements. For example, if the stoichiometric ratio is set as 1, ones in the range of 0.85 to 1.20 are allowed. In addition, even with different ones in a case of being represented by the below general formula, ones in which the ratio of the elements of the A site and the elements of the B site are the same may be regarded as the same compound oxide.

$$(1-x)[BiFeO_3]-x[BaTiO_3]$$

$$(0<x<0.40) \quad (1)$$

$$(Bi_{1-x}Ba_x)(Fe_{1-x}Ti_x)O_3$$

$$(0<x<0.40) \quad (1')$$

In addition, the compound oxide configuring the piezoelectric layer 70 of the present embodiment may further include elements other than Bi, Fe, Ba, and Ti. Examples of the other elements include Mn, Co, Cr, or the like. Even in the case of a compound oxide including these other elements, it is preferable to have a perovskite structure.

In a case where the piezoelectric layer 70 includes Mn, Co, and Cr, Mn, Co, and Cr are a compound oxide with a structure positioned at the B site of the perovskite structure. For example, in the case where Mn is included, the compound oxide configuring the piezoelectric layer 70 is represented as a compound oxide having a structure in which a part of Fe of a solid solution in which bismuth ferrite and barium titanate are evenly solid soluted is substituted with Mn, or a perovskite structure of a mixed crystal of bismuth manganate ferrite and barium titanate, and the basic characteristics are the same as the compound oxide having a perovskite structure of a mixed crystal of bismuth ferrite and barium titanate; however, it is understood that the leakage characteristics are improved. In addition, even in a case where Co or Cr is included, the leakage characteristics are improved in the same manner as Mn. Here, in an X-ray diffraction pattern, the bismuth ferrite, barium titanate, bismuth manganate ferrite, bismuth cobalt ferrite, and bismuth chromate ferrite are not detected singly. In addition, although Mn, Co, and Cr have been described as examples, it is understood that the leakage characteristics are improved in the same manner even in a case where two elements of other transition metal elements are included at the same time, and it is also possible to set these as the piezoelectric layer 70, and furthermore, other known additives may be included in order to improve the characteristics.

The piezoelectric layer 70 formed of the complex oxide having the perovskite structure including Mn, Co, and Cr in addition to Bi, Fe, Ba, and Ti is, for example, a mixed crystal represented by the following general formula (2). In addition, it is possible to represent this formula (2) by the following general formula (2'). Here, in the general formula (2) and the general formula (2'), M is Mn, Co, or Cr. Here, the description of the general formula (2) and the general formula (2') is a composition expression based on stoichiometry, and, as described above, to the extent that a perovskite structure is obtainable, inevitable composition deviation due to lattice mismatch, oxygen loss, and the like is allowed. For example, if the stoichiometric ratio is 1, ones in the range of 0.85 to 1.20 are allowed. In addition, even with different ones in a case of being represented by the below general formula, ones in which the ratio of the elements of the A site and the elements of the B site are the same may be regarded as the same compound oxide.

$$(1-x)[Bi(Fe_{1-y},M_y)O_3]-x[BaTiO_3]$$

$$(0<x<0.40, 0.01<y<0.10) \quad (2)$$

$$(Bi_{1-x}Ba_x)((Fe_{1-y},M_y)_{1-x}Ti_x)O_3$$

$$(0<x<0.40, 0.01<y<0.10) \quad (2')$$

Here, the orientation state of the piezoelectric layer 70 is not particularly limited, and may be one having priority orientation in the (110) plane, one with priority orientation in the (100) plane, or one with priority orientation in the (111) plane. Here, in the present embodiment, "with priority orientation in the (110) plane, the (100) plane, or the (111) plane" (the orientation plane with priority orientation is referred to as the "priority orientation plane") includes cases where all the crystals are oriented in the "priority orientation plane", and cases where most of the crystals (for example, 80% or more) are oriented in the "priority orientation plane".

The orientation degree of the "priority orientation plane" of the piezoelectric layer 70=[area of diffraction peak derived from the "priority orientation plane" of the piezoelectric layer 70]/[sum of the areas of the diffraction peaks of the (100) plane, the (110) plane, and the (111) plane derived from the piezoelectric layer 70] A lead electrode 90 made of, for example, gold (Au) or the like, which is drawn from the vicinity of the end portion on the ink supply channel 14 side and is extended up to on the elastic film 50 or on the insulating film that is provided according to necessity, is connected to each second electrode 80 which is an individual electrode of the piezoelectric element 300.

A protective substrate 30 having the manifold portion 31 configuring at least a part of a manifold 100 is bonded on the flow channel-forming substrate 10 on which the piezoelectric element 300 is formed, that is, on the first electrode 60, the elastic film 50 or the insulating film provided according to necessity, and the lead electrode 90, using an adhesive 35. In the present embodiment, the manifold portion 31 penetrates the protective substrate 30 in the thickness direction, is formed along the width direction of the pressure generating chambers 12, and is communicated with the communicating portion 13 in the flow channel-forming substrate 10 as described above, thereby configuring the manifold 100 which is the common ink chamber of each pressure generating chamber 12. In addition, only the manifold portion 31 may be used as the manifold by dividing the communicating portion 13 in the flow channel-forming substrate 10 into plural sections for each of the pressure generating chambers 12. Furthermore, for example, the ink supply channel 14 communicating the manifold 100 and each of the pressure generating chambers 12 to members interposed between the flow channel-forming substrate 10 and the protective substrate 30 (for example, the elastic film 50, the insulating film provided according to necessity, and the like) may be provided by providing only the pressure generating chambers 12 in the flow channel-forming substrate 10.

In addition, a piezoelectric element supporting portion 32 having a space that does not hinder the movement of the piezoelectric element 300 is provided in a region in the protective substrate 30 which faces the piezoelectric element 300. The piezoelectric supporting portion 32 simply has to have a space that does not hinder the movement of the piezoelectric element 300, and the space may or may not be sealed.

As the protective substrate 30, it is preferable to use materials having substantially the same coefficient of thermal expansion as the flow channel-forming substrate 10, for example, glass, ceramic materials, and the like, and the protective substrate was formed using a silicon single crystal substrate of the same material as the flow channel-forming substrate 10 in the present embodiment.

In addition, a through hole 33 that penetrates the protective substrate 30 in the thickness direction is provided in the protective substrate 30. Then, the through hole is provided so that the vicinity of the end portion of the lead electrode 90 drawn from each of the piezoelectric elements 300 is exposed in the through hole 33.

In addition, a driving circuit 120 for driving the piezoelectric elements 300 provided in parallel is fixed on the protective substrate 30. It is possible to use, for example, a circuit substrate, a semiconductor integrated circuit (IC), and the like as the driving circuit 120. Here, the driving circuit 120 and the lead electrode 90 are electrically connected via a connecting wire 121 composed of a conductive wire, such as a bonding wire.

In addition, a compliance substrate 40 formed of a sealing film 41 and a fixing plate 42 is bonded on the protective substrate 30. Here, the sealing film 41 is formed of a material having low stiffness and flexibility, and one surface of the manifold portion 31 is sealed by the sealing film 41. In addition, the fixing plate 42 is formed of a relatively hard material. Since the region of the fixing plate 42 facing the manifold 100 forms an opening portion 43 that is completely removed in the thickness direction, the one surface of the manifold 100 is sealed only by the sealing film 41 having flexibility.

In the ink jet type recording head I of the present embodiment, after an ink is taken in from an ink introducing opening connected with an external ink supplying unit (not shown) and the inner portion from the manifold 100 to the nozzle openings 21 is filled with the ink, a voltage is applied between the respective first electrode 60 and the second electrode 80 which correspond to the pressure generating chamber 12 according to recording signals (driving signals) from the driving circuit 120, and the elastic film 50, the adhering layer 56, the first electrode 60, and the piezoelectric layer 70 are deformed by bending, thereby increasing the pressure inside each of the pressure generating chambers 12 and ejecting ink droplets from the nozzle openings 21.

Figure 5:
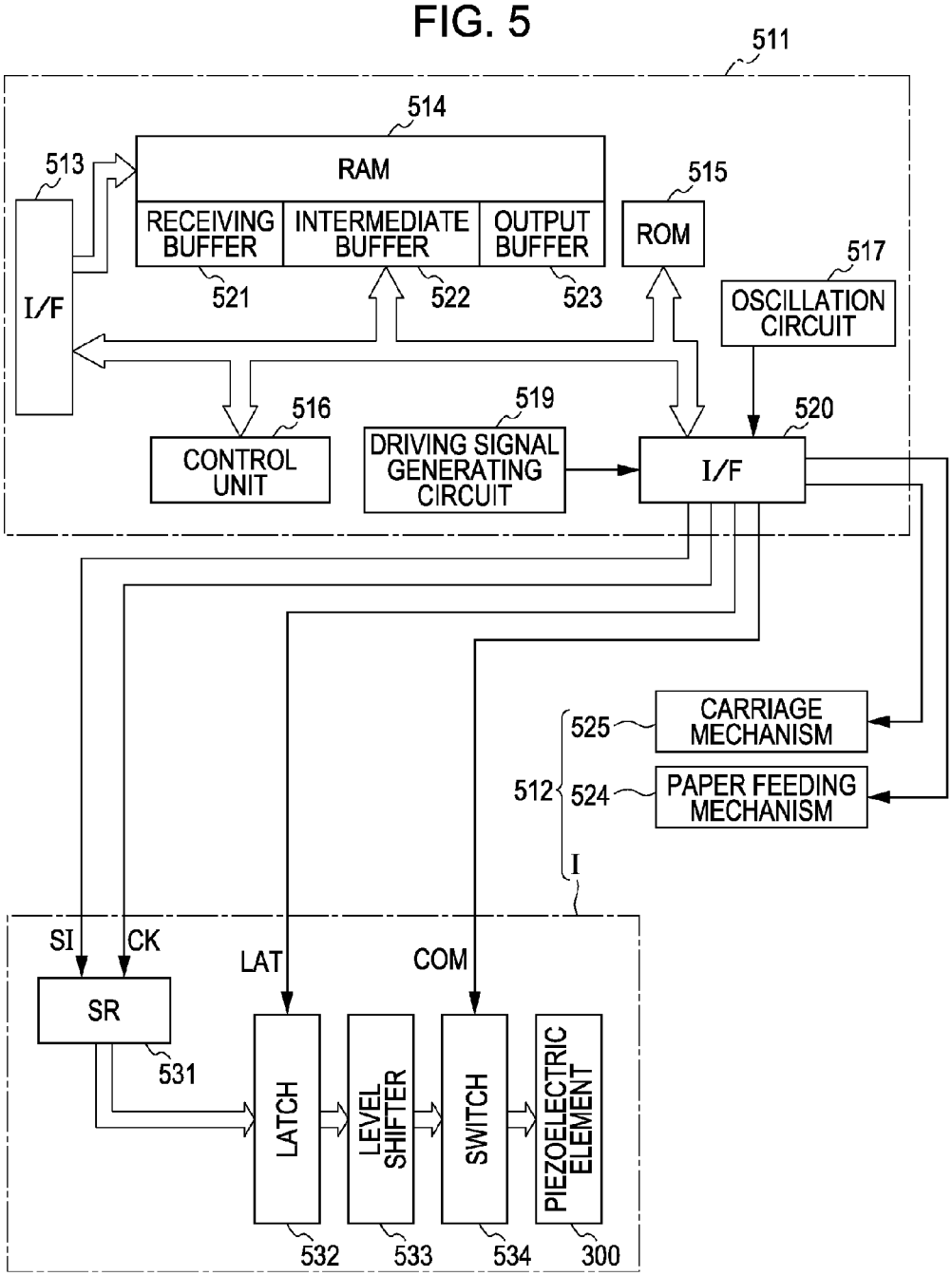
FIG. 5 is a block diagram showing the control configuration of the recording apparatus according to the embodiment.

FIG. 5 is a block diagram showing a control configuration example of such an ink jet type recording apparatus. With reference to FIG. 5, description will be given of the control of the ink jet type recording apparatus of the present embodiment. As shown in FIG. 5, the ink jet type recording apparatus of the present embodiment is schematically configured by a printer controller 511 and a print engine 512. The printer controller 511 is provided with an external interface 513 (below referred to as external I/F 513), a RAM 514 temporarily storing various data, a ROM 515 storing a control program and the like, a control unit 516 configured by including a CPU or the like, an oscillation circuit 517 generating a clock signal, a driving signal generating circuit 519 generating a driving signal for supplying to the ink jet type recording head I, and an internal interface 520 (below, referred to as internal I/F 520) transmitting a dot pattern data (bit map data) or the like developed based on the driving signal and the print data to the print engine 512.

For example, the external I/F 513 receives print data configured by character codes, graphic functions, image data, and the like from a host computer or the like (not shown). In addition, a busy signal (BUSY) and an acknowledge signal (ACK) are output with respect to the host computer or the like through this external I/F 513. The RAM 514 functions as a receiving buffer 521, an intermediate buffer 522, an output buffer 523, and a work memory (not shown). Then, the receiving buffer 521 temporarily stores print data received by the external I/F 513, the intermediate buffer 522 stores intermediate code data converted by the control unit 516, and the output buffer 523 stores the dot pattern data. Here, the dot pattern data are configured by print data obtained by decoding (translating) gradation data.

In addition, in the ROM 515, font data, graphic functions, or the like are stored in addition to a control program (control routine) for performing various types of data processing.

The control unit 516 reads out the print data in the receiving buffer 521, and stores the intermediate code data obtained by converting the print data in the intermediate buffer 522. In addition, the control unit 516 analyzes the intermediate code data read out from the intermediate buffer 522, refers to the font data, graphic functions, and the like stored in the ROM 515, and develops the intermediate code data into dot pattern data. Then, after carrying out the necessary decorative processing, the control unit 516, the developed dot pattern data are stored in the output buffer 523. Furthermore, the control unit 516 also functions as a waveform setting unit, and controls the driving signal generating circuit 519, thereby setting the waveform shape of the driving signal generated from the driving signal generating circuit 519. The control unit 516 configures a driving circuit (not shown) and the like to be described later and, along with this, configures the driving unit according to an embodiment of the invention. In addition, as the liquid ejecting driving apparatus driving the ink jet type recording head I, it is sufficient to provide at least this driving unit, and in the present embodiment, one including the printer controller 511 is exemplified.

Then, when dot pattern data corresponding to one row of the ink jet type recording head I are obtained, the dot pattern data for one row are output to the ink jet type recording head I through the internal I/F 520. In addition, when the dot pattern data of one row are output from the output buffer 523, developed intermediate code data are erased from the intermediate buffer 522, and the development process is performed for the next intermediate code data.

The print engine 512 is configured to include the ink jet type recording head I, a paper feeding mechanism 524, and a carriage mechanism 525. The paper feeding mechanism 524 is configured by a paper feeding motor, the platen 8, and the like, and sequentially feeds out a printing recording medium such as recording paper or the like in synchronization with the recording operation of the ink jet type recording head I. That is, the paper feeding mechanism 524 relatively moves the printing recording medium in the sub-scanning direction.

The carriage mechanism 525 is configured by the carriage 3 on which the ink jet type recording head I is able to be mounted, and a carriage driving unit which causes the carriage 3 to travel along the main scanning direction, and the ink jet type recording head I is moved in the main scanning direction by the traveling of the carriage 3. Here, the carriage driving unit is configured by the driving motor 6, the timing belt 7, and the like as described above.

The ink jet recording head I has a large number of nozzle openings 21 along the sub-scanning direction, and ejects liquid droplets from each of the nozzle openings 21 at a timing set according to the dot pattern data or the like. Then, an electrical signal, for example, a driving signal (COM), recording data (SI), or the like to be described later, is supplied through external wiring (not shown) to the piezoelectric element 300 of the ink jet type recording head I. In the printer controller 511 and the print engine 512 configured in this manner, the printer controller 511 and a driving circuit (not shown), which has a latch 532, a level shifter 533, a switch 534, and the like which selectively input a driving signal having a predetermined driving waveform output from the driving signal generating circuit 519 to the piezoelectric element 300, are driving units applying a predetermined driving signal to the piezoelectric element 300.

Here, a shift resistor (SR) 531, the latch 532, the level shifter 533, the switch 534 and the piezoelectric element 300 are respectively provided at each nozzle opening 21 of the ink jet type recording head I, and the shift resistor 531, the latch 532, the level shifter 533, and the switch 534 generate a driving pulse from an ejection driving signal or a relaxation driving signal generated by the driving signal generating circuit 519. Here, the driving pulse may be an applied pulse which is applied to the piezoelectric element 300 in practice.

In the ink jet type recording head I, initially, synchronization is performed with a clock signal (CK) from the oscillation circuit 517, recording data (SI) configuring the dot pattern data are serially transmitted to a shift register 531 from the output buffer 523, and set in sequence. In such a case, first, the data of the most significant bits in the printing data of all the nozzle openings 21 is serially transmitted, and when the serial transmission of the data of the most significant bits is finished, the data of the bits which are second most significant are serially transmitted. Below, in the same manner, the data of the lower order bits is sequentially serially transmitted.

Then, when the recording data of the bits of all the nozzles is set in each shift register 531, the control unit 516 outputs a latch signal (LAT) to the latch 532 at a predetermined timing. According to the latch signal, the latch 532 latches the printing data set in the shift register 531. The recording data (LATout) latched by the latch 532 is applied to the level shifter 533 which is a voltage amplifier. In a case where the recording data are, for example, "1", this level shifter 533 increases the recording data to a voltage value which the switch 534 is capable of driving, for example, up to several tens of volts. Then, the increased recording data are applied to each switch 534, and each switch 534 enters a connected state according to the recording data.

Then, the driving signal (COM) generated by the driving signal generating circuit 519 is also applied in each switch 534, and when the switch 534 selectively enters a connected state, the driving signal is selectively applied to the piezoelectric element 300 connected to the switch 534. In this manner, in the illustrated ink jet type recording head I, it is possible to control whether or not the ejection driving signal is applied to the piezoelectric element 300 according to the recording data. For example, in a period in which the recording data are "1", since the switch 534 enters the connected state due to the latch signal (LAT), it is possible to supply the driving signal (COMout) to the piezoelectric element 300, and the piezoelectric element 300 is displaced (deformed) according to the supplied driving signal (COMout). In addition, in a period in which the recording data are "0", since the switch 534 enters an unconnected state, the supply of the driving signal to the piezoelectric element 300 is interrupted. In the period in which the recording data are "0", since each piezoelectric element 300 holds the immediately previous potential, the immediately previous displacement state is maintained.

Here, the above-described piezoelectric element 300 is a flexural vibration mode piezoelectric element 300. When this flexural vibration mode piezoelectric element 300 is used, by the piezoelectric layer 70 shrinking in an orthogonal direction (31 direction) to the voltage in accordance with the voltage, the piezoelectric element 300 and the vibrating plate are bent to the pressure generating chamber 12 side, whereby the pressure generating chamber 12 is made to contract. On the other hand, by extending the piezoelectric layer 70 in the 31 direction by reducing the voltage, the piezoelectric element 300 and the vibrating plate are bent to the opposite side of the pressure generating chamber 12, whereby the pressure generating chamber 12 is made to expand. In this ink jet recording head I, since the corresponding volume of the pressure generating chamber 12 changes in accordance with the charging and discharging with respect to the piezoelectric element 300, it is possible to eject liquid droplets from the nozzle openings 21 by using the pressure variation of the pressure generating chamber 12.

Here, description will be given of the driving waveform representing the driving signal (COM) of the present embodiment which is input to the piezoelectric element 300. Here, FIG. 6 is a driving waveform showing a driving signal of the present embodiment.

The driving waveform input to the piezoelectric element 300 sets a common electrode (the first electrode 60) to a reference potential (in the present embodiment, Vbs) and is applied to an individual electrode (the second electrode 80). That is, the voltage applied to the individual electrode (the second electrode 80) according to the driving waveform is shown as the potential with the reference potential (Vbs) set as a reference.

Figure 6:
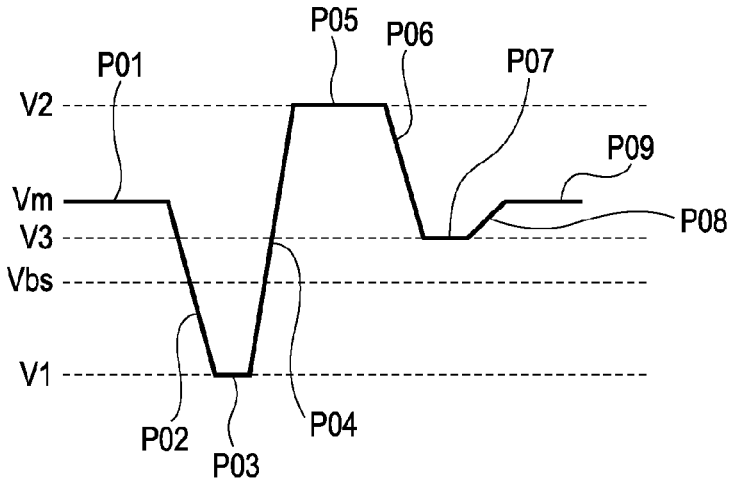
FIG. 6 is a view showing a driving signal (driving waveform) according to the embodiment.

As shown in FIG. 6, in a preparation state (driving standby state) to input the driving waveform, for example, the driving waveform which is the reference of the present embodiment enters a state in which an intermediate potential Vm higher than a coercive voltage is applied. The process which maintains this intermediate potential Vm is a standby process P01 of setting the piezoelectric layer 70 to a polarization state, and following this, a first voltage changing process P02 of decreasing the potential from a state in which the intermediate potential Vm is maintained to a first potential V1 which is the minimum potential of an opposite polarity to the intermediate potential Vm, and, along with this, expanding the pressure generating chamber 12, a first holding process P03 of maintaining the first potential V1 for a constant time, a second voltage changing process P04 of increasing the potential from the first potential V1 to a second potential V2 which is the maximum potential and is larger than the intermediate potential Vm with the opposite polarity to the first potential V1 and the same polarity as the intermediate potential Vm to thereby contract the pressure generating chamber 12, a second holding process P05 of maintaining the second potential V2 for a constant time, a third voltage changing process P06 of decreasing the potential from the second potential V2 to a third potential V3 smaller than the intermediate potential Vm to thereby expand the pressure generating chamber 12, a third holding process P07 of maintaining the third potential V3 for a constant time, a fourth voltage changing process P08 of increasing the potential from the third potential V3 to the intermediate potential Vm, and a process P09 of maintaining the intermediate potential Vm, are configured. Here, the third voltage changing process P06 of causing a decrease from the second potential V2 to the third potential V3 slightly lower than the intermediate potential Vm, the third holding process P07 of maintaining the third potential V3 for a constant time, and the fourth voltage changing process P08 of increasing the potential from the potential V3 to the intermediate potential Vm, are for stabilizing the meniscus after ejecting liquid droplets, and have been widely known for some time.

The predetermined piezoelectric layer 70 formed of a compound oxide having a perovskite structure including Mn, Co, and Cr in addition to the Bi, Fe, Ba, and Ti of the present embodiment is not maintained in a polarized state in a state where the power is turned off, and is in a non-polarized state (including a case of a substantially non-polarized state where a small part maintains polarization), and when entering a preparation state (driving standby state) in which the above-described driving waveform 200 is output to the piezoelectric element 300, the piezoelectric layer 70 enters a state in which the intermediate potential Vm is applied and the piezoelectric layer 70 enters a polarized state. Then, when the above-described driving waveform is input, the potential is changed from the intermediate potential Vm to the minimum potential V1 of the opposite polarity by the first voltage changing process P02, and the polarization of the piezoelectric layer 70 is reduced. At the same time as this, the piezoelectric element 300 is deformed in the direction in which the area of the pressure generating chamber 12 expands, and the meniscus inside the nozzle opening 21 is drawn to the pressure generating chamber 12 side. Next, by the piezoelectric element 300 being deformed in the direction in which the area of the pressure generating chamber 12 is made to contract by the second voltage changing process P04, the meniscus inside the nozzle opening 21 is greatly pushed out from the pressure generating chamber 12 side, and liquid droplets are ejected from the nozzle opening 21.

Here, the first potential V1 is a negative potential, for example, −15 V to −1 V. When converted to an electric field, this potential is −16.7 V/μm to −1.1 V/μm. Then, in the second voltage changing process P04, an increase is caused from the first potential V1 to the second potential V2 which is a maximum potential greater than the intermediate potential Vm at the same polarity as the intermediate potential Vm and the opposite polarity to the first potential V1. In the present embodiment, when the potential difference between the first potential V1 and the second potential V2 is 30 V to 60 V, upon conversion to an electric field of $3.3\times10^7$ to $6.6\times10^7$ (V/m), the pressure generating chamber 12 is made to contract.

In the present embodiment, in a case where the piezoelectric element 300 provided with the piezoelectric layer 70 formed of the above-described predetermined piezoelectric material is driven, the driving waveform is set to have a process of holding at an intermediate potential Vm of the coercive voltage or more and setting the piezoelectric element to a polarized state, a process of applying the first potential V1 which is a minimum voltage of the opposite polarity to the intermediate potential Vm from the application state of the intermediate potential Vm and reducing the polarization of the piezoelectric layer, and a process of applying the second potential V2 which is a maximum voltage greater than the intermediate potential Vm from the application state of the first potential V1 and ejecting a liquid, and the electric field applied to the piezoelectric layer according to the application of the intermediate potential is made to be 11.1 V/μm or more and greater than half of the difference of the electric field applied to the piezoelectric layer in the maximum potential and the minimum potential, whereby the effect of ensuring a large displacement amount is achieved. Here, the intermediate potential of the coercive voltage or more indicates a voltage of a voltage equal to or higher than the coercive voltage when a hysteresis curve of the piezoelectric layer 70 is drawn at a low frequency (for example, 66 Hz to 1 kHz); however, attention should be paid to the fact that a substantially high electric field is changed in an increasing direction by raising the frequency of the driving waveform. In the present embodiment, this is 5 V or more, and in the electric field, 5.5 V/μm or more.

In order to complete the present embodiment, first, for the predetermined piezoelectric layer 70 formed of the complex oxide having the perovskite structure including Mn, Co, and Cr in addition to Bi, Fe, Ba, and Ti, when the electric field is removed from a state in which the electric field is received, polarization occurs, and distortion is caused without being able to maintain the polarized state, the polarization is reduced over time and a non-distorted state is attained. Then, it was found that, when the predetermined voltage changing process is applied from the polarized state, the reduction of the polarization is promoted by the electric field, and a reduced polarization state is set in a short period, after which it is possible to obtain a large displacement.

In addition, it was found that, when the voltage is changed from the reduced polarization state to the second potential V2 which is the maximum voltage, in a compound oxide having a perovskite structure including bismuth (Bi), iron (Fe), barium (Ba) and titanium (Ti) oriented with priority in the (110) plane, non-180° domain rotation is generated and it is possible to obtain a large displacement amount. For the compound oxide oriented with priority in the (110) plane and used in the present embodiment, the polarization axes have two states, and, since one of the polarization axis directions is an orthogonal direction with respect to the electric field, it is not originally involved in the displacement. However, when driven by the driving waveform as described above, the direction of the polarization axis which is not originally involved in the displacement is changed by the second voltage changing process. This is referred to as non-180° domain rotation, in which a displacement amount based on the non-180° domain rotation is applied to the displacement amount in accordance with the original piezoelectric constant, with the result that it is possible to obtain a large displacement amount.

The displacement due to such non-180° domain rotation has a small effect even when the compound oxide having a perovskite structure including Bi, Fe, Ba, and Ti oriented with priority in the (100) plane, that is, a BFO-BT based piezoelectric material is used. This means, in the compound oxide including the Bi, Fe, Ba, and Ti oriented in the (100) plane, the displacement occurs in a stabilized state, and it is possible to obtain a desired displacement amount in proportion to the original piezoelectric constant in the second voltage changing process P04 of the driving waveform.

Although there are some differences depending on the orientation state in this manner, it was found that, in all the orientation states, by performing driving in which the electric field applied to the piezoelectric layer by the application of the intermediate potential is 11.1 V/μm or more and greater than half of the difference in the electric field applied to the piezoelectric layer in the maximum potential V2 and the minimum potential V1, the displacement amount is increased.

Test Example 1

The displacement amounts of the piezoelectric element 300 provided with the piezoelectric layer 70 oriented in the (110) plane of the following Examples and the piezoelectric element 300 provided with the piezoelectric layer 70 oriented in the (100) plane of the following comparative example 1 were measured. Using the driving waveform shown in FIG. 6 as the basic waveform and fixing the potential difference ΔV of the maximum potential and the minimum potential to 35 V, the first voltage was set to an optimal voltage (0 to −10 V) in the Example sample measured previously, and by applying a waveform in which the intermediate potential Vm of the driving waveform was changed in a state with an interval of 200 ms and a sufficient delay time, the displacement amount of the piezoelectric element 300 was determined. By time-integrating speed data measured with a laser Doppler vibrometer manufactured by Graphtec Co., Ltd. in an oscilloscope manufactured by Dekuroi Co., Ltd., the displacement amount was calculated (25° C.). The measurement sample was processed into the shape of FIG. 3, a segment in which a cavity was formed was used, and measurement was performed by applying each driving waveform.

Figure 7:
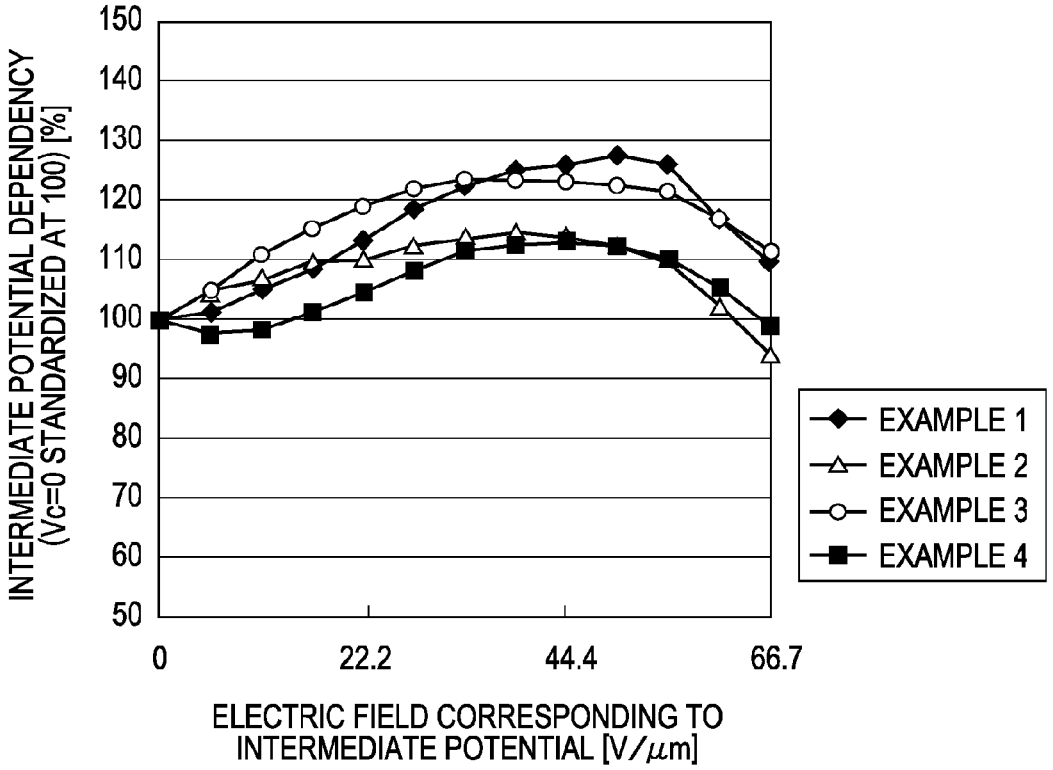
FIG. 7 is a view showing electric field and displacement characteristics of a test example 1.

FIG. 7 shows the relationship between the displacement amounts of each piezoelectric element 300 of Examples 1 to 4 measured using the above-described method and the electric field (V/m).

Here, in consideration of the intermediate potential Vm of the driving waveform shown in FIG. 6 and the film thickness (900 nm) of the piezoelectric layer 70, the electric field (V/m) is shown as changes of the applied electric field.

Figure 8:
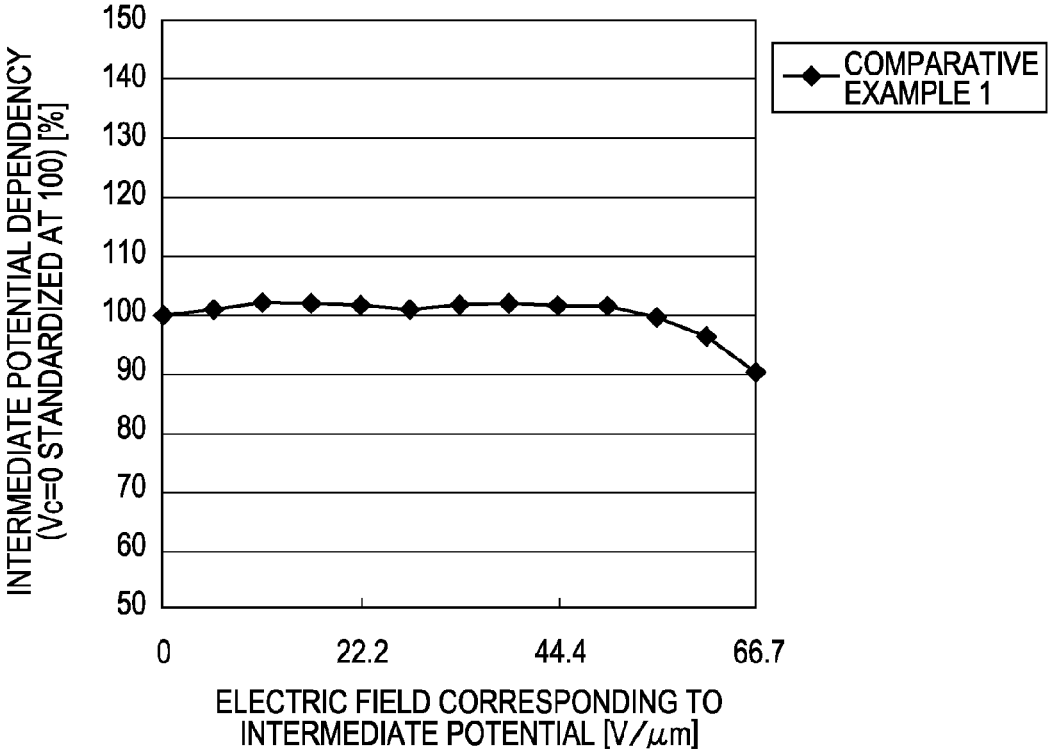
FIG. 8 is a view showing electric field and displacement characteristics of the test example 1.

In addition, the results of comparative example 1 are shown in FIG. 8 in the same manner.

As a result, in the Example of the BFO-BT-based piezoelectric material, it is understood that when the intermediate potential Vm is 17.5 V or more which is half of the potential difference ΔV=35 V, and increased to greater than 19.4 V/μm upon conversion to an electric field, the displacement amount has a tendency to become large. In contrast, in a case of the PZT set as the comparative example 1, it is understood that there is no tendency for the displacement amount to increase even when the intermediate potential is increased, and rather that there is a tendency for the displacement amount to decrease.

Example 1

(110) Plane Orientated BFO-BT-Based

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After a zirconium layer was formed with a thickness of 40 nm by the DC sputtering method as the adhesion layer on the zirconia layer, a 100 nm thick platinum film (first electrode 60) oriented in the (111) plane was formed using the same DC sputtering method.

Next, a piezoelectric film is laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode 60 formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 750° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Example 2

(100) Plane Orientated BFO-BT-Based

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After a zirconium layer was formed with a thickness of 40 nm by the DC sputtering method as the adhesion layer on the zirconia layer, a 50 nm thick platinum film (first electrode 60) oriented in the (111) plane was formed using the same DC sputtering method. On this platinum film, lanthanum nickel ($LaNiO_3$) was deposited with a thickness of 40 nm by the sputtering method or a sol-gel method and set as a seed layer to control the orientation.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode 60 formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 650° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Example 3

Other than the fact that the baking temperature in the RTA up to the ninth layer was 800° C., Example 3 was implemented in the same manner as Example 1. With regard to the tenth layer to the twelfth layer, coating to baking (for the tenth to twelfth layers, the baking in the RTA was 750° C.) were performed with a solution to which each element of 3% Li, 3% B, and 1% Cu were added with respect to Bi in the precursor solution.

Example 4

Example 4 was implemented in the same manner as Example 1 with the piezoelectric composition set to 0.75

$[(Bi,Fe_{0.89},Mn_{0.02}, Ti_{0.09}]O_3]-0.25-[BaTiO_3]$ and the RTA baking temperature set to 800° C.

Comparison Example 1

A piezoelectric layer was formed using a precursor solution obtained by mixing lead acetate trihydrate ($Pb(CH_3COO)_2.3H_2O$), titanium isopropoxide ($Ti[OCH(CH_3)_2]_4$), zirconium acetylacetonate ($Zr(CH_3COCHCOCH_3)_4$) as the main raw materials, butyl cellosolve ($C_6H_{14}O_6$) as the solvent, diethanolamine ($C_4H_{11}NO_2$) as the stabilizer, and polyethylene glycol ($C_2H_6O_6$) as a thickening agent.

Embodiment 2

For the liquid ejecting apparatus according to the present embodiment, it is possible to apply the configuration of the liquid ejecting apparatus according to Embodiment 1 shown in FIG. 1 to FIG. 5 and the driving waveform shown in FIG. 6. Below, description will be given of the points which are different to Embodiment 1.

The piezoelectric layer 70 of the present embodiment is oriented with priority in the (100) plane. Here, in the present embodiment, "oriented with priority in the (100) plane" includes cases where all the crystals are oriented in the (100) plane, and cases where most of the crystals (for example, 90% or more) are oriented in the (100) plane. Specifically, for the piezoelectric layer 70 of the present embodiment, the orientation degree of the (100) plane is 0.90 or more, preferably 0.99 or more.

In this embodiment, the first potential V1 of the driving waveform shown in FIG. 6 is a negative potential; however, with a voltage of −5 V or more, the negativity becomes less. As a result, as will be described in detail later, it is possible to form V1, which is a negative potential, comparatively easily, and it is possible to stabilize and maintain the displacement of the piezoelectric layer 70, which is oriented with priority in the (100) plane, at a high level.

In the present embodiment, in a case where the piezoelectric element 300 provided with the piezoelectric layer 70 formed of the above-described predetermined piezoelectric material is driven, the driving waveform is set to have a process of holding at an intermediate potential Vm of the coercive voltage or more and setting the piezoelectric element to a polarized state, a process of applying the first potential V1 which is a potential of −5 V or more and which is a minimum voltage of the opposite polarity to the intermediate potential Vm from the application state of the intermediate potential Vm, and reducing the polarization of the piezoelectric layer, and a process of applying the second potential V2 which is a maximum voltage greater than the intermediate potential Vm from the application state of the first voltage and ejecting a liquid, whereby the effect of ensuring a large displacement amount is achieved. Here, the intermediate voltage of the coercive voltage or more refers to a voltage of a voltage equal to or higher than the coercive voltage when a hysteresis curve of the piezoelectric layer 70 is drawn at a low frequency (for example, 66 Hz to 1 kHz) and is 10 V or more in the present embodiment.

In order to complete the present embodiment, first, for the predetermined piezoelectric layer 70 formed of the complex oxide having the perovskite structure including Mn, Co, and Cr in addition to Bi, Fe, Ba, and Ti, when the electric field is removed from a state in which the electric field is received, polarization occurs, and distortion is caused without being able to maintain the polarized state, the polarization is reduced over time and a non-distorted state is attained. Then, it was found that, when the predetermined voltage changing process is applied from the polarized state, the reduction of the polarization is promoted by the electric field, and a reduced polarization state is set in a short period, after which it is possible to obtain a large displacement.

In addition, the conditions at the time of setting the reduced polarization state change greatly according to the orientation state of the piezoelectric layer 70, for example, in an orientation state other than (100) orientation, the greater the size of the minimum potential for setting the reduced polarization state, that is, the greater the negative potential, the greater the displacement; however, in the case of (100) orientation, it was found that the ratio by which the displacement is increased as the negative potential is increased is remarkably small in comparison with other orientations. From this finding, it was understood that, in comparison with increasing the negative potential, whereby the power supply design becomes complicated and costly, by preserving the negative potential to be small, it is possible to realize a stable piezoelectric element at a low cost as a result.

Thus, the present embodiment is characterized in the point that, after the process P01 in which the intermediate potential Vm is maintained, the first potential V1, which is the minimum potential of the opposite polarity to the intermediate potential Vm and which is a negative potential, is set as a small potential as a negative potential of −5 V or more (−5 or more and less than 0 V). When converted to an electric field, this potential is −5.6 V/μm or more.

This is because, in the piezoelectric layer of the (100) orientation, even when the first potential V1 is −5 V or more, it is possible to obtain sufficient displacement, and if the first potential V1 is −5 V or more, it is possible to apply the negative potential even without making any special design changes, leading to lower costs as a result.

Here, for V1, which is a negative voltage, it is possible to realize V1=−2.5 V by applying Vbs=5 V to the second electrode 80 which is a common electrode and setting V1 to 2.5 V. In this manner, if the voltage is −5 V or more, easy implementation is possible using a power supply prepared for driving the control chip serving as the control unit, and there is no need to prepare a special power supply.

Test Example 11

Figure 9:
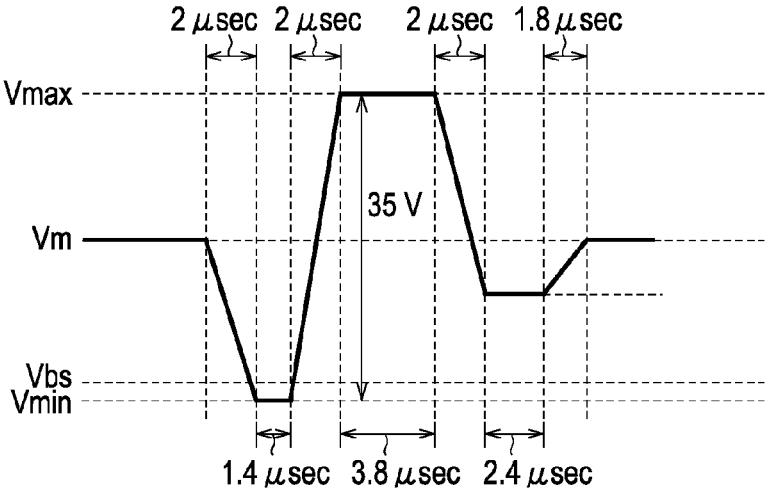
FIG. 9 is a view illustrating a driving waveform used by the test examples 11 and 31.
Figure 10:
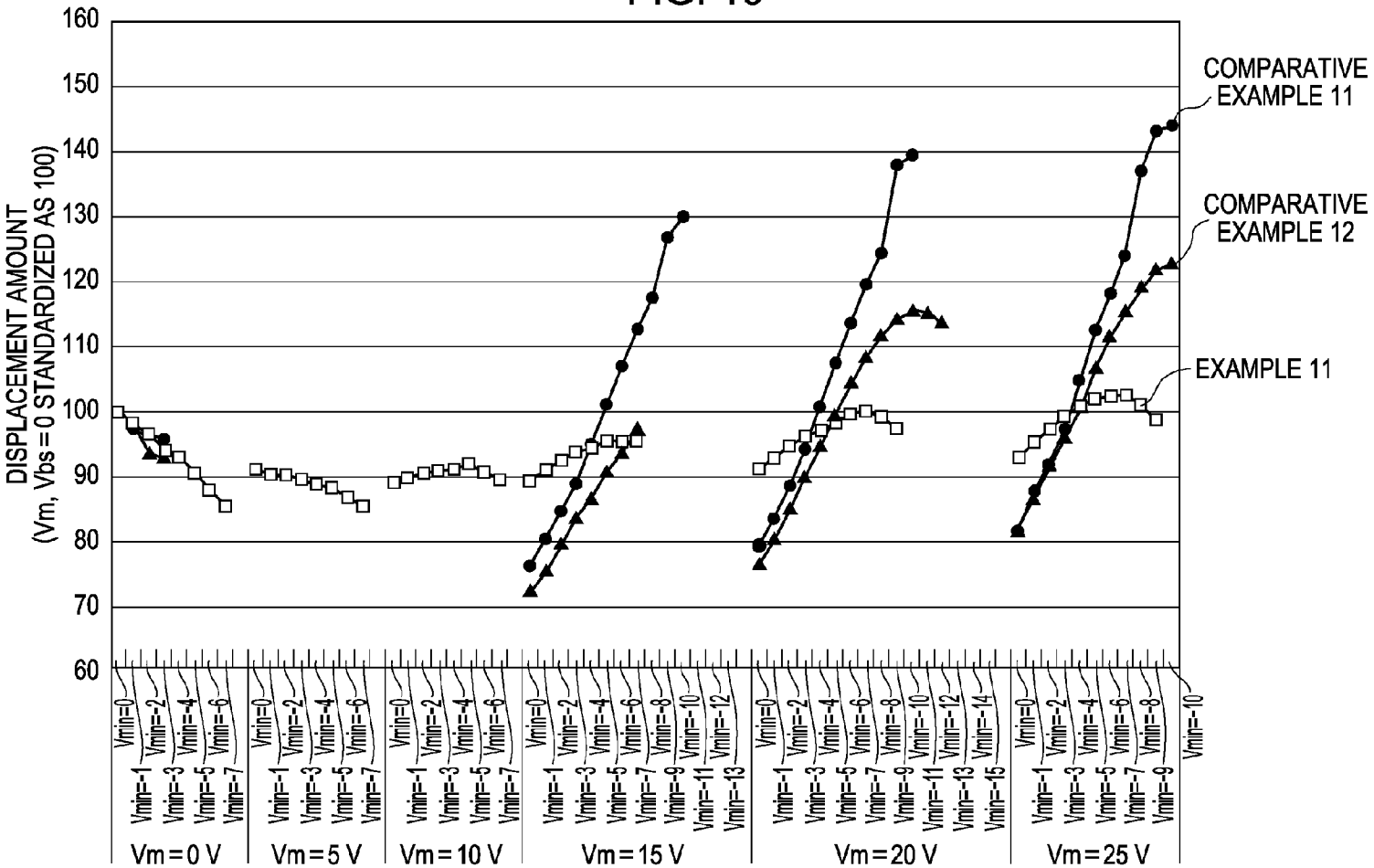
FIG. 10 is a view showing results of the test example 11.

Using the driving waveform shown in FIG. 9 as a base and with the driving waveform set as a constant at ΔV=35 V, a waveform in which Vm and Vmin are changed is applied to the piezoelectric element 300 provided with the piezoelectric layer 70 with the composition of the following Example 11, in a state with an interval of 200 ms and a sufficient delay time, and the results determining the displacement amount of the piezoelectric element 300 are shown in FIG. 10. By time-integrating speed data measured with a laser Doppler vibrometer manufactured by Graphtec Co., Ltd. in an oscilloscope manufactured by Dekuroi Co., Ltd., the displacement amount was calculated (25° C.). The measurement sample was processed into the shape of FIG. 3, a segment in which a cavity was formed was used, and measurement was performed by applying each driving waveform. Here, each displacement amount is represented with a case where Vm and Vmin=0 standardized as 100.

As a result, it is understood that, in the piezoelectric element 300 provided with the piezoelectric layer 70 oriented with priority in the (100) plane of Example 11, in cases where Vm=0 V and Vm=5 V, when the negativity of Vmin is increased, the displacement is decreased; however, in cases where Vm=10 V, Vm=15 V, Vm 20 V, and Vm=25 V, the more the negativity of Vmin is increased, the more the displacement is increased, and saturation occurs at a certain voltage.

On the other hand, it is shown that, when Vm=10 V, Vm=15 V, Vm=20 V, and Vm=25 V, the standby state becomes the polarization state, as the negativity of Vmin is greater, the state changes from a state of polarization and distortion to one in which the electric field is removed and reduced polarization occurs over time without distortion, when the predetermined voltage changing process is applied from the polarized state, the reduction of the polarization is promoted by the electric field, and a reduced polarization state is set in a short period, after which it is possible to obtain a large displacement. However, in Example 11 with (100) orientation, since the effect due to the reduced polarization according to the increasing negativity of Vmin is small, Vmin also represents good cost reduction of the power supply up to approximately −5 V.

For comparison, the results of performing the same for the cases of ones (the following comparative examples 11 and 12) provided with piezoelectric layers oriented in the (110) plane or in the (111) plane are similarly shown in FIG. 10. As a result, it is understood that, in a case where the piezoelectric material has (110) plane orientation or (111) plane orientation, when Vm=15 V, Vm=20 V, and Vm=25 V and when Vmin is approximately 0 to −5, the displacement amount is smaller than in a case where Vm=0; however, the more the negativity of Vmin is increased past −5 V, the more the displacement is increased, and saturation occurs at a certain voltage. Thus, it is understood that, in a case of having a piezoelectric layer with (110) plane orientation or (111) plane orientation, when Vmin is −5 V or more (low negativity), the displacement amount becomes small and usage is not possible.

Example 11

(100) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After zirconium was formed with a thickness of 40 nm by the DC sputtering method as the adhesion layer on the zirconia layer, a 50 nm thick platinum film (the first electrode 60) oriented in the (111) plane was formed using the same DC sputtering method. On this platinum film, lanthanum nickel ($LaNiO_3$) was deposited with a thickness of 40 nm by the sputtering method or the sol-gel method and set as a seed layer to control the orientation.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode 60 formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 650° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Comparative Example 11

(110) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After zirconium was formed with a thickness of 40 nm by the DC sputtering method as the adhesion layer on the zirconia layer, a 100 nm thick platinum film (first electrode 60) oriented in the (111) plane was formed using the same DC sputtering method.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 750° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Comparative Example 12

(111) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After zirconium was formed with a thickness of 40 nm by the DC sputtering method as the adhesion layer on the zirconia layer, a 100 nm thick platinum film (first electrode 60) oriented in the (111) plane was formed using the same DC sputtering method. Next, a thin film of 20 nm was formed by coating the compound oxide of bismuth iron cobalt and barium titanate ($BiFeCoO_3$—$BaTiO_3$) using the sol-gel method and performing RTA baking at 725° C. for three minutes. With the previously described layer as a seed layer, orientation control was performed.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 775° C. for 5 minutes and a piezoelectric film was formed (baking process). The series of processes of the coating process, the drying process, the degreasing process, and the baking process were repeated 10 times, and the piezoelectric layer 70 having a thickness of 900 nm as a whole formed of 10 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Embodiment 3

For the liquid ejecting apparatus according to the present embodiment, it is possible to apply the configuration of the liquid ejecting apparatus according to Embodiment 1 shown in FIG. 1 to FIG. 5 and the driving waveform shown in FIG. 6. Below, description will be given of the points which are different to Embodiment 1.

The piezoelectric layer 70 of the present embodiment is oriented with priority in the (100) plane. Here, in the present embodiment, "oriented with priority in the (100) plane" includes cases where all the crystals are oriented in the (100) plane, and cases where most of the crystals (for example, 80% or more) are oriented in the (100) plane. Specifically, for the piezoelectric layer 70 of the present embodiment, the orientation degree of the (100) plane is 0.80 or more, preferably 0.90 or more.

In the present embodiment, the first potential V1 of the driving waveform shown in FIG. 6 is a negative potential, for example, −15 V to −1 V. When converted to an electric field, this potential is −16.7 V/μm to −1.1 V/μm. Then, in the second voltage changing process P04, an increase is caused from the first potential V1 to the second potential V2 which is a maximum potential greater than the intermediate potential Vm at the same polarity as the intermediate potential Vm and the opposite polarity to the first potential V1. In the present embodiment, when the potential difference between the first potential V1 and the second potential V2 is 55 V or more, upon conversion to an electric field of $6.1\times10^7$ (V/m) or more, the pressure generating chamber 12 is made to contract.

In the present embodiment, in a case where the piezoelectric element 300 provided with the piezoelectric layer 70 formed of the above-described predetermined piezoelectric material is driven, the driving waveform is set to have a process of holding at an intermediate potential Vm of the coercive voltage or more and setting the piezoelectric element to a polarized state, a process of applying the first potential V1 which is a minimum voltage of the opposite polarity to the intermediate potential Vm from the application state of the intermediate potential Vm and reducing the polarization of the piezoelectric layer, and a process of applying the second potential V2 which is a maximum voltage greater than the intermediate potential Vm from the application state of the first potential V1 and ejecting a liquid, and when the potential difference between the first potential V1 and the second potential V2 is 55 V or more, upon conversion to an electric field of $6.1\times10^7$ (V/m) or more, the pressure generating chamber 12 is made to contract, whereby the effect of ensuring a large displacement amount is achieved. Here, the intermediate voltage of the coercive voltage or more indicates a voltage of a voltage equal to or higher than the coercive voltage when a hysteresis curve of the piezoelectric layer 70 is drawn at a low frequency (for example, 66 Hz to 1 kHz); however, attention should be paid to the fact that the substantial coercive voltage is changed in an increasing direction by raising the frequency of the driving waveform. In the present embodiment, this is 10 V or more, and in the electric field, 11.1 V/μm or more.

In order to complete the present embodiment, first, for the predetermined piezoelectric layer 70 formed of the complex oxide having the perovskite structure including Mn, Co, and Cr in addition to Bi, Fe, Ba, and Ti, when the electric field is removed from a state in which the electric field is received, polarization occurs, and distortion is caused without being able to maintain the polarized state, the polarization is reduced over time and a non-distorted state is attained. Then, it was found that, when the predetermined voltage changing process is applied from the polarized state, the reduction of the polarization is promoted by the electric field, and a reduced polarization state is set in a short period, after which it is possible to obtain a large displacement.

In addition, it was found that, when the voltage is changed from the reduced polarization state to the second potential V2 which is the maximum voltage, in a compound oxide having a perovskite structure including bismuth (Bi), iron (Fe), barium (Ba) and titanium (Ti) oriented with priority in the (100) plane and the (110) plane, the displacement amount is different according to the difference of the orientation property. Specifically, the displacement amount of the compound oxide with (100) plane orientation increases linearly in accordance with the application of the electric field; however, the displacement amount of the (110) plane orientation increases non-linearly. For the compound oxide with the (100) plane orientation with a rhombohedral symmetrical structure used in this embodiment, the direction of the spontaneous polarization has an inclination of approximately 45° C. with respect to the electric field, and the resultant vector of the polarization direction matches with the electric field application direction. For this reason, in the compound oxide with (100) plane orientation, the displacement occurs in a stabilized state, and it is possible to obtain a desired displacement amount in proportion to the original piezoelectric constant in the second voltage changing process P04 of the driving waveform, and it is possible to obtain a displacement amount which is greater as the change in the voltage is greater. Meanwhile, in the compound oxide having the perovskite structure including Bi, Fe, Ba, and Ti with the (110) plane orientation with the rhombohedral symmetrical structure, that is, the BFO-BT based piezoelectric material, the polarization direction has two states with respect to the electric field. Then, for the polarization axis of the direction orthogonal with respect to the electric field direction, which is one of these states, in the second voltage changing process P04 of the driving waveform, a change in the direction of the spontaneous polarization, that is, non-180° domain rotation, is generated, and displacement which is larger than the displacement based on the original piezoelectric constant is generated; however, the majority of the non-180° domain rotation phenomenon occurs in a comparatively low electric field region. Thus, in a case where the piezoelectric element is driven in a high electric field region, it is possible to obtain a greater displacement amount by using a compound oxide with (100) plane orientation in the piezoelectric element. For this large displacement amount, in comparison with a case where PZT, which is generally used as a piezoelectric material, is used in the piezoelectric element, when the potential difference between the second potential V2 and the first potential V1 is 60 V and is converted into an electric field, approximately the same displacement amount is achieved when the electric field is $6.7\times10^7$ (V/m).

Example 21

(100) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After zirconium was formed with a film thickness of 40 nm by the DC sputtering method as the adhesion layer on the zirconia layer, a 50 nm thick platinum film (first electrode 60) oriented in the (111) plane was formed using the same DC sputtering method. On this platinum film, lanthanum nickel ($LaNiO_3$) was deposited with a thickness of 40 nm by the sputtering method or the sol-gel method and set as a seed layer to control the orientation.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 650° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Comparative Example 21

(110) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After zirconium was formed with a film thickness of 40 nm by the DC sputtering method as the adhesion layer on the zirconia layer, a 100 nm thick platinum film (first electrode 60) oriented in the (111) plane was formed using the same DC sputtering method.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 750° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Test Example 21

The displacement amounts of the piezoelectric element 300 provided with the piezoelectric layer 70 oriented in the (100) plane of Example 21 and the piezoelectric element 300 provided with the piezoelectric layer 70 oriented in the (110) plane of comparative example 21 were measured.

Using the driving waveform shown in FIG. 6 as the basic waveform, and setting the intermediate potential of the driving waveform to Vm=20, the first potential V1 which is the minimum potential was set to the potential in which the displacement amount in each orientation became the maximum, that is, in the case of (100) plane orientation, V1=−7 V, and in the case of (110) plane orientation, V1=−10 V. Then, by setting the potential difference ΔV from the minimum potential V1 of the driving waveform to the maximum potential V2 as the driving voltage (V), and by applying a waveform in which the intermediate potential difference ΔV of the driving waveform was changed in a state with an interval of 200 ms and a sufficient delay time, the displacement amount of the piezoelectric element 300 was determined. Here, the electric field (V/m) was calculated from the relationship of the driving voltage (V) and the film thickness (900 nm) of the piezoelectric layer 70. By time-integrating speed data measured with a laser Doppler vibrometer manufactured by Graphtec Co., Ltd. in an oscilloscope manufactured by Dekuroi Co., Ltd., the displacement amount was calculated (25° C.). The measurement sample was processed into the shape of FIG. 3, a segment in which a cavity was formed was used, and measurement was performed by applying each driving waveform.

Figure 11:
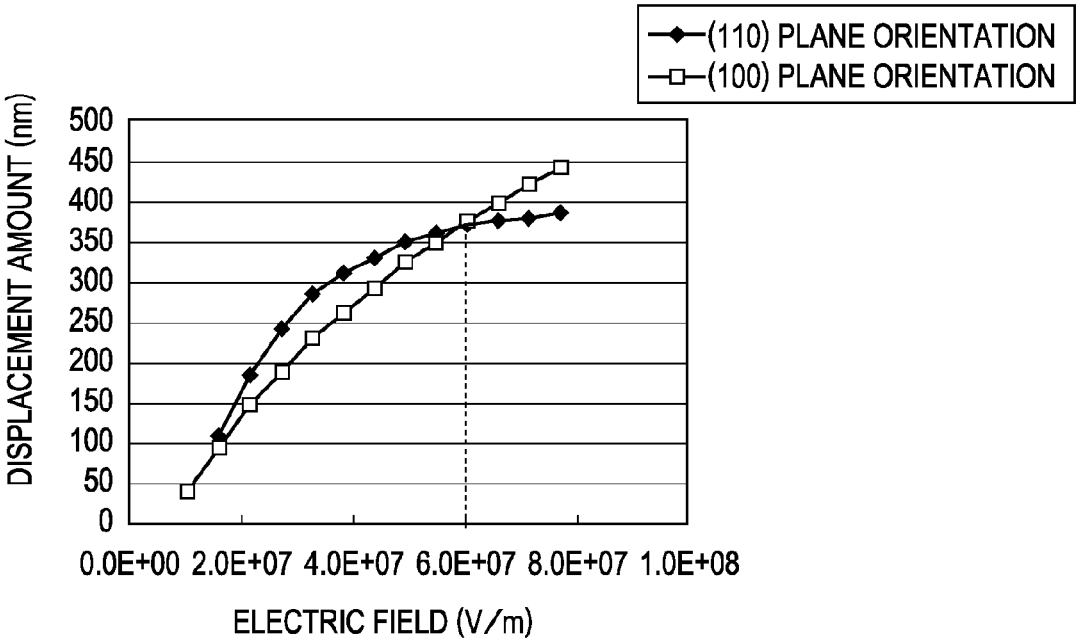
FIG. 11 is a view showing the electric field and displacement amount of the test examples 21 and 41.

FIG. 11 shows the relationship between the displacement amounts (nm) of each piezoelectric element 300 measured using the above-described method and the electric field (V/m). Here, in consideration of the potential difference ΔV between the second potential V2 and the first potential V1 of the driving waveform shown in FIG. 6 and the film thickness (900 nm) of the piezoelectric layer 70, the electric field (V/m) is shown as changes of the applied electric field.

As a result, it is understood that, when the piezoelectric element with (100) plane orientation of Example 21 is driven, in a region where the electric field converted from the potential difference between the second potential V2 and the first potential V1 of the driving waveform is greater than $6.1\times10^7$ (V/m), the displacement amount becomes greater than comparative example 21 with (110) plane orientation, and when the electric field becomes smaller than $6.1\times10^7$ (V/m), it becomes smaller than the (110) plane orientation. Thus, by driving the piezoelectric element using the BFO-BT based piezoelectric material with the (100) plane orientation with a predetermined driving waveform such that the electric field becomes $6.1\times10^7$ (V/m) or more, it is possible to obtain the effect of improving the displacement amount. In addition, since the displacement amount of the piezoelectric element with (100) plane orientation is increased in a linear manner from a low electric field to a high electric field region, by using the BFO-BT based piezoelectric material with (100) plane orientation, it is possible to obtain a desired displacement amount corresponding to the electric field strength.

Embodiment 4

For the liquid ejecting apparatus according to the present embodiment, it is possible to apply the configuration of the liquid ejecting apparatus according to Embodiment 1 shown in FIG. 1 to FIG. 5 and the driving waveform shown in FIG. 6. Below, description will be given of the points which are different to Embodiment 1.

The piezoelectric layer 70 of the present embodiment is oriented with priority in the (110) plane or the (111) plane. Here, in the present embodiment, "oriented with priority in the (110) plane or the (111) plane" includes cases where all the crystals are oriented in the (110) plane or the (111) plane, and cases where most of the crystals (for example, 80% or more) are oriented in the (110) plane or the (111) plane. Specifically, for the piezoelectric layer 70 of the present embodiment, the orientation degree of the (110) plane or the (111) plane is 0.80 or more, preferably 0.9 or more.

In the present embodiment, the first potential V1 of the driving waveform shown in FIG. 6 is a negative potential and is set to −15 V to −5 V. When converted to an electric field, this potential is −16.7 V/μm to −5.6 V/μm. As a result, as will be described in detail later, it is possible to maintain the displacement of the piezoelectric layer 70, which is oriented with priority in the (110) plane or the (111) plane, at a remarkably high level.

In the present embodiment, in a case where the piezoelectric element 300 provided with the piezoelectric layer 70 formed of the above-described predetermined piezoelectric material is driven, the driving waveform is set to have a process of holding at an intermediate potential Vm of the coercive voltage or more and setting the piezoelectric element to a polarized state, a process of applying the first voltage V1 which is a minimum voltage of the opposite polarity to the intermediate potential Vm from the application state of the intermediate potential Vm and which is a potential of −16.7 V/μm to −5.6 V/μm when converted to an electric field, and reducing the polarization of the piezoelectric layer, and a process of applying the second potential V2 which is a maximum voltage greater than the intermediate potential Vm from the application state of the first voltage V1 and ejecting a liquid, whereby the effect of ensuring a large displacement amount is achieved. Here, the intermediate potential Vm of the coercive voltage or more indicates a voltage of a voltage equal to or higher than the coercive voltage when a hysteresis curve of the piezoelectric layer 70 is drawn at a low frequency (for example, 66 Hz to 1 kHz); however, attention should be paid to the fact that a substantially high electric field is changed in an increasing direction by raising the frequency of the driving waveform. In the present embodiment, this is 10 V or more, and in the electric field, 11.1 V/μm or more.

In order to complete the present embodiment, first, for the predetermined piezoelectric layer 70 formed of the complex oxide having the perovskite structure including Mn, Co, and Cr in addition to Bi, Fe, Ba, and Ti, when the electric field is removed from a state in which the electric field is received, polarization occurs, and distortion is caused without being able to maintain the polarized state, the polarization is reduced over time and a non-distorted state is attained. Then, it was found that, when the predetermined voltage changing process is applied from the polarized state, the reduction of the polarization is promoted by the electric field, and a reduced polarization state is set in a short period, after which it is possible to obtain a large displacement.

In addition, it is understood that the conditions at the time of setting the reduced polarization state change greatly according to the orientation state of the piezoelectric layer 70, for example, in the orientation state of the (110) plane or the (111) plane, the greater the size of the minimum potential for setting the reduced polarization state, that is, the greater the negative potential, the greater the displacement. Meanwhile, it is understood that, in the case of (100) orientation, the ratio by which the negative potential is increased and the displacement is increased is remarkably small in comparison with the (110) plane or (111) plane orientation. Thus, according to this finding, it is understood that in a case where the piezoelectric layer 70 which is oriented in the (110) plane or the (111) plane is provided, when the first potential V1 which is the minimum potential is set to −15 V to −5 V, it is possible to obtain a large displacement.

The present embodiment is characterized in the point that, after the process P01 in which the intermediate potential Vm is maintained, the first potential V1, which is the minimum potential of the opposite polarity to the intermediate potential Vm, is set as a negative potential of −15 V to −5 V.

This is because, in the piezoelectric layer of the (110) plane or the (111) plane, when the first potential V1 is set to the range of −15 V to −5 V, preferably −14 V to −6 V, it is possible to obtain a large displacement.

Here, for V1, which is a negative voltage, it is possible to realize V1=−12.5 V by applying, for example, Vbs=15 V to the second electrode 80 which is a common electrode and setting V1 to 2.5 V.

Test Example 31

Figure 12:
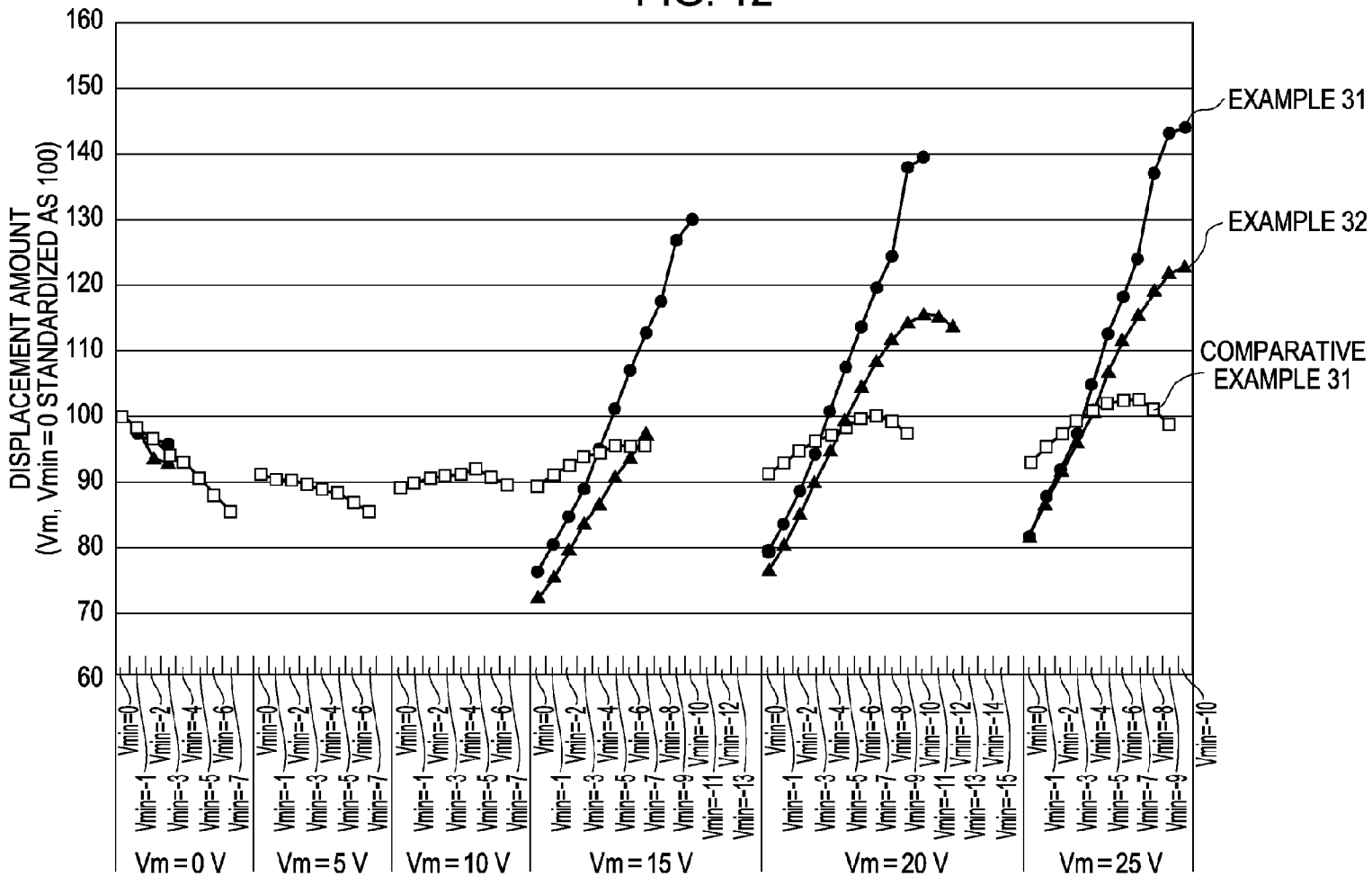
FIG. 12 is a view showing results of the test example 31.

Using the driving waveform shown in FIG. 9 as a base and with the driving waveform set as a constant at ΔV=35 V, a waveform in which Vm and Vmin are changed is applied to the piezoelectric element 300 provided with the piezoelectric layer 70 with the composition of the following Examples 31 and 32, in a state with an interval of 200 ms and a sufficient delay time, and the results determining the displacement amount of the piezoelectric element 300 are shown in FIG. 12. By time-integrating speed data measured with a laser Doppler vibrometer manufactured by Graphtec Co., Ltd. in an oscilloscope manufactured by Dekuroi Co., Ltd., the displacement amount was calculated (25° C.). The measurement sample was processed into the shape of FIG. 3, a segment in which a cavity was formed was used, and measurement was performed by applying each driving waveform. Here, each displacement amount is represented with a case where Vm and Vmin=0 standardized as 100.

As a result, it is shown that, in the piezoelectric element 300 provided with the piezoelectric layer 70 oriented in the (110) plane and oriented with priority in the (111) plane of Examples 31 and 32, when Vm=10 V, Vm=15 V, Vm=20 V, and Vm=25 V, the standby state becomes the polarization state, as the negativity of Vmin is greater, the state changes from a state of polarization and distortion to one in which the electric field is removed and reduced polarization occurs over time without distortion, when the predetermined voltage changing process is applied from the polarized state, the reduction of the polarization is promoted by the electric field, and a reduced polarization state is set in a short period, after which it is possible to obtain a large displacement.

Thus, in the piezoelectric element 300 provided with the piezoelectric layer 70 oriented in the (110) plane and oriented with priority in the (111) plane of Examples 31 and 32, it is understood that Vmim corresponding to the first potential V1 is set to −15 V to −5 V, preferably −14 V to −6 V. When converted to an electric field, it is −16.7 V/μm to −5.6 V/μm, and preferably, −6.7 V/μm to 15.6 V/μm.

For comparison, the results of performing the same for the cases of ones (the following comparative example 31) provided with piezoelectric layers oriented in the (100) plane are similarly shown in FIG. 12. As a result, it is understood that in a case where the piezoelectric material has (100) plane orientation, even when Vm exceeds −5 V and the negativity is increased, it is not possible to see a large improvement in the displacement amount.

Example 31

(110) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After 40 nm of zirconium was formed by the DC sputtering method as the adhesion layer on the zirconia layer, a 100 nm thick platinum film (first electrode 60) oriented in the (111) plane was formed using the same DC sputtering method.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 750° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Example 32

(111) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After 40 nm of zirconium was formed by the DC sputtering method as the adhesion layer on the zirconia layer, a 100 nm thick platinum film (first electrode 60) oriented in the (111) plane was formed using the same DC sputtering method. Next, a thin film of 20 nm was formed by coating the compound oxide of bismuth iron cobalt and barium titanate ($BiFeCoO_3$—$BaTiO_3$) using the sol-gel method and performing RTA baking at 725° C. for three minutes. With the previously described layer as a seed layer, orientation control was performed.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 775° C. for 5 minutes and a piezoelectric film was formed (baking process). The series of processes of the coating process, the drying process, the degreasing process, and the baking process were repeated 10 times, and the piezoelectric layer 70 having a thickness of 900 nm as a whole formed of 10 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Comparative Example 31

(100) Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After 40 nm of zirconium was formed by the DC sputtering method as the adhesion layer on the zirconia layer, a 50 nm thick platinum film (first electrode 60) oriented in the (111) plane was formed using the same DC sputtering method. On this platinum film, lanthanum nickel ($LaNiO_3$) was deposited with a thickness of 40 nm by the sputtering method or the sol-gel method and set as a seed layer to control the orientation.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 650° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Test Example 32

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After 40 nm of zirconium was formed by the DC sputtering method as the adhesion layer on the zirconia layer, a 100 nm thick platinum film (first electrode 60) oriented in the (111) plane was formed using the same DC sputtering method.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were prepared as a precursor solution such that each element had the molar ratio and composition described below.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 750° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti. Here, when the XRD of the piezoelectric layer 70 was measured before providing the second electrode 80 and the orientation state was observed, the orientation was in the (110) plane.

Figure 13:
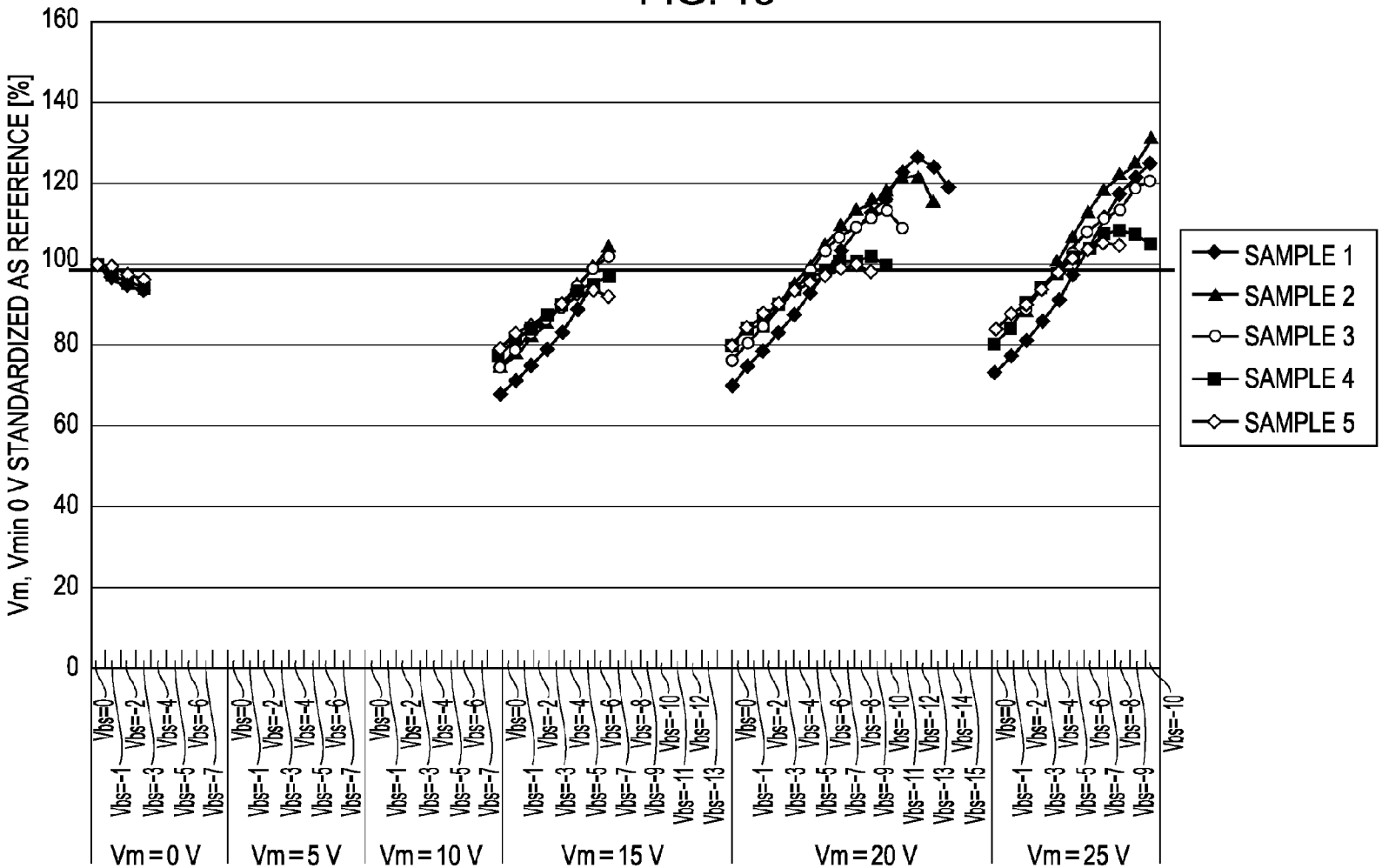
FIG. 13 is a view showing results of the test example 32.

For the piezoelectric elements of samples 1 to 5 in which precursor solutions were configured as follows, the results of measuring in the same manner as for Test Example 31 are shown in FIG. 13.

As a result, in BFO-BT based non-lead based piezoelectric material, the improvement of the displacement amount was remarkable in a case where the potential of Vmim was more negative as the BFO ratio was greater, and sample 1, in which BFO/BT=79/21, was the most remarkable. In addition, in the piezoelectric element with (110) plane orientation with such a configuration, Vmin corresponding to the first voltage is −6 V to −14 V and when it is converted to an electric field, it is understood that setting to −6.7 V/μm to 15.6 V/μm is preferable.

Precursor Solution

Here, BFO indicates a compound oxide of Ba:Fe=1:1, and BT indicates a compound oxide of Ba:Ti=1:1.

Sample 1: BFO/BT=79/21
Sample 2: BFO/BT=77/23
Sample 3: BFO/BT=75/25
Sample 4: BFO/BT=73/27
Sample 5: BFO/BT=71/29

Embodiment 5

For the liquid ejecting apparatus according to the present embodiment, it is possible to apply the configuration of the liquid ejecting apparatus according to Embodiment 1 shown in FIG. 1 to FIG. 5 and the driving waveform shown in FIG. 6. Below, description will be given of the points which are different to Embodiment 1.

The piezoelectric layer 70 of the present embodiment is oriented with priority in the (110) plane. Here, in the present embodiment, "oriented with priority in the (110) plane" includes cases where all the crystals are oriented in the (110) plane, and cases where most of the crystals (for example, 80% or more) are oriented in the (110) plane. Specifically, for the piezoelectric layer 70 of the present embodiment, the orientation degree of the (110) plane is 0.80 or more, preferably 0.90 or more.

In the present embodiment, the first potential V1 of the driving waveform shown in FIG. 6 is a negative potential, for example, −15 V to −1 V. When converted to an electric field, this potential is −16.7 V/μm to −1.1 V/μm. Then, in the second voltage changing process P04, an increase is caused from the first potential V1 to the second potential V2 which is a maximum potential greater than the intermediate potential Vm at the same polarity as the intermediate potential Vm and the opposite polarity to the first potential V1. In the present embodiment, when the potential difference between the first potential V1 and the second potential V2 is less than 55 V, upon conversion to an electric field of $6.1\times10^7$ (V/m) or less, the pressure generating chamber 12 is made to contract.

In the present embodiment, in a case where the piezoelectric element 300 provided with the piezoelectric layer 70 formed of the above-described predetermined piezoelectric material is driven, the driving waveform is set to have a process of holding at an intermediate potential Vm of the coercive voltage or more and setting the piezoelectric element to a polarized state, a process of applying the first potential V1 which is a minimum voltage of the opposite polarity to the intermediate potential Vm from the application state of the intermediate potential Vm and reducing the polarization of the piezoelectric layer, and a process of applying the second potential V2 which is a maximum voltage greater than the intermediate potential Vm from the application state of the first potential V1 and ejecting a liquid, and when the potential difference between the first potential V1 and the second potential V2 is less than 55 V, upon conversion to an electric field of $6.1\times10^7$ (V/m) or less, the pressure generating chamber 12 is made to contract, whereby the effect of ensuring a large displacement amount is achieved. Here, the intermediate potential of the coercive voltage or more indicates a voltage of a voltage equal to or higher than the coercive voltage when a hysteresis curve of the piezoelectric layer 70 is drawn at a low frequency (for example, 66 Hz to 1 kHz); however, attention should be paid to the fact that a substantially high electric field is changed in an increasing direction by raising the frequency of the driving waveform. In the present embodiment, this is 5 V or more, and in the electric field, 5.5 V/μm or more.

In order to complete the present embodiment, first, for the predetermined piezoelectric layer 70 formed of the complex oxide having the perovskite structure including Mn, Co, and Cr in addition to Bi, Fe, Ba, and Ti, when the electric field is removed from a state in which the electric field is received, polarization occurs, and distortion is caused without being able to maintain the polarized state, the polarization is reduced over time and a non-distorted state is attained. Then, it was found that, when the predetermined voltage changing process is applied from the polarized state, the reduction of the polarization is promoted by the electric field, and a reduced polarization state is set in a short time, after which it is possible to obtain a large displacement.

In addition, it was found that, when the voltage is changed from the reduced polarization state to the second potential V2 which is the maximum voltage, in a compound oxide having a perovskite structure including bismuth (Bi), iron (Fe), barium (Ba) and titanium (Ti) oriented with priority in the (110) plane, non-180° domain rotation is generated and it is possible to obtain a large displacement amount. For the compound oxide oriented with priority in the (110) plane and used in the present embodiment, the polarization axes have two states, and, since one of the polarization axis directions is an orthogonal direction with respect to the electric field, it is not originally involved in the displacement. However, when driven by the driving waveform as described above, the direction of the polarization axis which is not originally involved in the displacement is changed by the second voltage changing process. This is referred to as non-180° domain rotation, in which a displacement amount based on the non-180° domain rotation is applied to the displacement amount in accordance with the original piezoelectric constant, with the result that it is possible to obtain a large displacement amount. As a result, even when the potential difference between the first potential V1 and the second potential V2 is suppressed to be comparatively small at 55 V or less, it is possible to ensure a large displacement amount.

The displacement due to such non-180° domain rotation has a small effect even when the compound oxide having a perovskite structure including Bi, Fe, Ba, and Ti oriented with priority in the (100) plane, that is, a BFO-BT based piezoelectric material is used. This means, in a compound oxide including Bi, Fe, Ba, and Ti with (100) plane orientation, since all the polarization axis directions have an inclination of 45° with respect to the electric field, and the vector of the synthesized polarization directions matches the electric field direction, the displacement amount applied to the piezoelectric constant is reduced in such BFO-BT based piezoelectric material with (100) orientation. Here, the displacement according to the non-180° domain rotation is even generated by PZT used as general piezoelectric material in the past; however, since the effect is small and the reliability is poor, substantial use is not possible.

Example 41

(110) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After 40 nm of zirconium was formed by the DC sputtering method as the adhesion layer on the zirconia layer, a 100 nm thick platinum film (first electrode 60) oriented in the (111) plane was formed using the same DC sputtering method.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 750° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Comparative Example 41

(100) Plane Orientation

Firstly, a 1200 nm thick silicon oxide ($SiO_2$) film was formed on the surface of a (110) single crystal silicon (Si) substrate by thermal oxidation. Next, a 400 nm thick zirconium film was created on the $SiO_2$ film by the DC sputtering method, and this was thermally treated (RTA) under an oxygen atmosphere to form a zirconia layer. After 40 nm of zirconium was formed by the DC sputtering method as the adhesion layer on the zirconia layer, a 50 nm thick platinum film (first electrode 60) oriented in the (111) plane was formed using the same DC sputtering method. On this platinum film, lanthanum nickel ($LaNiO_3$) was deposited with a thickness of 40 nm by the sputtering method or the sol-gel method and set as a seed layer to control the orientation.

Next, a piezoelectric film was laminated on the first electrode 60, and set as the piezoelectric layer 70. The method was as follows. First, each n-octane solution of 2-ethylhexanoic acid bismuth, 2-ethylhexanoic acid iron, 2-ethylhexanoic acid manganese, 2-ethylhexanoic acid barium, and 2-ethylhexanoic acid titanium were mixed such that the molar ratio of each element became Bi:Ba:Fe:Ti:Mn=75:25:71.25:25:3.75 (BFO:BT=75:25), and a precursor solution was prepared.

Then, the precursor solution was dropped on the substrate having the first electrode formed thereon, and the substrate was rotated at 3000 rpm to form a piezoelectric precursor film (coating process). Next, on a hot plate, drying was performed at 180° C. for 2 minutes (drying process). Next, degreasing was carried out at 350° C. for 4 minutes (degreasing process). Next, in an oxygen atmosphere, using a Rapid Thermal Annealing (RTA) apparatus, baking was performed at 650° C. for 5 minutes and a piezoelectric film was formed (baking process). The series of processes of the coating process, the drying process, the degreasing process, and the baking process were repeated 12 times, and the piezoelectric layer 70 having a thickness of 900 nm as a whole formed of 12 layers of piezoelectric films was formed.

Thereafter, a 50 nm thick iridium film (second electrode 80) was formed on the piezoelectric layer 70 by the sputtering method as the second electrode 80, thereby forming the piezoelectric element 300 as the piezoelectric layer 70 having a compound oxide having the perovskite structure including Bi, Fe, Mn, Ba, and Ti.

Test Example 41

The displacement amounts of the piezoelectric element 300 provided with the piezoelectric layer 70 oriented in the (110) plane of Example 41 and the piezoelectric element 300 provided with the piezoelectric layer 70 oriented in the (100) plane of comparative example 41 were measured. Using the driving waveform shown in FIG. 6 as the basic waveform, and setting the intermediate potential of the driving waveform to Vm=20 V, the first potential V1 which is the minimum potential was set to the potential in which the displacement amount in each orientation became the maximum, that is, in the case of (110) plane orientation, V1=−10 V, and in the case of (100) plane orientation, V1=−7 V. Then, by setting the potential difference ΔV from the minimum potential V1 of the driving waveform to the maximum potential V2 as the driving voltage (V), and by applying a waveform in which the intermediate potential difference ΔV of the driving waveform was changed in a state with an interval of 200 ms and a sufficient delay time, the displacement amount of the piezoelectric element 300 was determined. By time-integrating speed data measured with a laser Doppler vibrometer manufactured by Graphtec Co., Ltd. in an oscilloscope manufactured by Dekuroi Co., Ltd., the displacement amount was calculated (25° C.). The measurement sample was processed into the shape of FIG. 3, a segment in which a cavity was formed was used, and measurement was performed by applying each driving waveform.

FIG. 11 shows the relationship between the displacement amounts (nm) of each piezoelectric element 300 measured using the above-described method and the electric field (V/m).

Here, in consideration of the potential difference ΔV between the second potential V2 and the first potential V1 of the driving waveform shown in FIG. 6 and the film thickness (900 nm) of the piezoelectric layer 70, the electric field (V/m) is shown as changes of the applied electric field.

As shown in FIG. 11, in the Example with (110) plane orientation, in a region where the electric field converted from the potential difference between the first potential V1 and the second potential V2 is comparatively small, the displacement amount becomes greater than comparative example 41 with (100) plane orientation, and it is understood that when the electric field becomes greater than $6.1\times10^7$ (V/m), it becomes smaller than the (100) plane orientation.

As a result, it is understood that to receive the benefit of the displacement amount improvement based on the non-180° domain rotation, the electric field is $6.1\times10^7$ (V/m) or less.

Thus, by driving using the BFO-BT based piezoelectric material with the (110) plane orientation with a predetermined driving waveform such that the electric field becomes $6.1\times10^7$ (V/m) or less, it is possible to obtain the effect of improving the displacement amount based on the non-180° domain rotation.

Other Embodiments

Thus far, an embodiment of the invention has been described; however, the basic configuration of the invention is not limited to that described above. For example, the above-described embodiments exemplified a silicon single crystal substrate as the flow channel-forming substrate 10; however, without being limited thereto, for example, materials, such as an SOI substrate and glass, may be used.

Furthermore, the above embodiment exemplified the piezoelectric element 300 in which the first electrode 60, the piezoelectric layer 70, and the second electrode 80 are sequentially laminated on a substrate (the flow channel-forming substrate 10); however, without being limited thereto, for example, it is possible to apply the invention even to a liquid ejecting apparatus provided with a vertical vibration-type piezoelectric element in which a piezoelectric material and an electrode-forming material are laminated alternately so as to expand in the width direction.

Here, in the above-described embodiments, description was given exemplifying an ink jet type recording apparatus as an example of a liquid ejecting apparatus and an ink jet type recording head as an example of a liquid ejecting head; however, the invention is widely aimed at liquid ejecting apparatuses in general and it is naturally possible to apply the invention to liquid ejecting apparatuses ejecting liquid other than ink. Examples of other liquid ejecting heads include a variety of recording heads that are used in an image recording apparatus, such as a printer; color material ejecting heads used to manufacture color filters, such as liquid crystal displays; electrode material ejecting heads used to form electrodes, such as organic EL displays and field emission displays (FED), biological organic substance ejecting heads used to manufacture bio chips, and the like, and it is possible to apply the invention to liquid ejecting apparatuses provided with these liquid ejecting heads.

What is claimed is:

1. A liquid ejecting apparatus comprising:

a piezoelectric element provided with a piezoelectric layer and an electrode provided on the piezoelectric layer; and a driving unit supplying a driving waveform driving the piezoelectric element to the piezoelectric element, wherein the piezoelectric layer is formed of a composite oxide having a perovskite structure including bismuth, iron, barium and titanium, wherein the driving waveform has a waiting process of applying an intermediate potential to the piezoelectric layer, a first voltage changing process of applying a voltage of the opposite polarity to the intermediate potential from the application state of the intermediate potential, and decreasing the potential to the minimum, and a second voltage changing process of applying a voltage greater than the intermediate potential and ejecting a liquid, and increasing the potential to the maximum from the minimum potential, and wherein an electric field applied to the piezoelectric layer by the application of the intermediate potential is 11.1 V/μm or more, and is greater than half of a difference between the maximum potential and the minimum potential in the electric field applied to the piezoelectric layer.

2. The liquid ejecting apparatus according to claim 1, wherein the piezoelectric layer is arranged with priority on a (100) plane.

3. The liquid ejecting apparatus according to claim 2, wherein the minimum potential is converted to the electric field and is −5.6 V/μm or more.

4. The liquid ejecting apparatus according to claim 2, wherein the difference between the maximum potential and the minimum potential in the electric field applied to the piezoelectric layer is 61 V/μm or more.

5. The liquid ejecting apparatus according to claim 1, wherein the piezoelectric layer is arranged with priority on a (110) plane.

6. The liquid ejecting apparatus according to claim 5, wherein the minimum potential is converted to the electric field and is −16.7 V/μm to −5.6 V/μm.

7. The liquid ejecting apparatus according to claim 5, wherein the difference between the maximum potential and the minimum potential in the electric field applied to the piezoelectric layer is 61 V/μm less.

8. The liquid ejecting apparatus according to claim 1, wherein the piezoelectric layer is arranged with priority on a (111) plane.

* * * * *